US007995958B2

(12) United States Patent
Gon et al.

(10) Patent No.: US 7,995,958 B2
(45) Date of Patent: Aug. 9, 2011

(54) IMAGE FORMING APPARATUS

(75) Inventors: Syoukou Gon, Osaka (JP); Yuzuru Nanjo, Osaka (JP); Akihiro Kondo, Osaka (JP); Eiji Nakajima, Osaka (JP); Naoyuki Ishida, Osaka (JP); Kenichi Kasama, Osaka (JP); Tamami Asari, Osaka (JP)

(73) Assignee: Kyocera Mita Corporation (JP)

( * ) Notice: Subject to any disclaimer, the term of this patent is extended or adjusted under 35 U.S.C. 154(b) by 364 days.

(21) Appl. No.: 12/411,617

(22) Filed: Mar. 26, 2009

(65) Prior Publication Data

US 2009/0245898 A1 Oct. 1, 2009

(30) Foreign Application Priority Data

Mar. 28, 2008 (JP) ..... 2008-085377
Jun. 30, 2008 (JP) ..... 2008-170520

(51) Int. Cl.
*G03G 15/20* (2006.01)
*H05B 6/02* (2006.01)

(52) U.S. Cl. ..... 399/332; 399/122; 399/328; 219/216; 219/619

(58) Field of Classification Search ..... 399/110, 399/122, 320, 328–332, 334, 335; 219/216, 219/219

See application file for complete search history.

(56) References Cited

U.S. PATENT DOCUMENTS

| | | | | |
|---|---|---|---|---|
| RE36,962 | E | 11/2000 | Higashi et al. | |
| 6,195,525 | B1 * | 2/2001 | Maeyama | 399/328 |
| 7,232,977 | B2 * | 6/2007 | Yamano | 219/619 |
| 7,268,327 | B2 | 9/2007 | Yamamoto et al. | |
| 2004/0136761 | A1 * | 7/2004 | Asakura et al. | 399/328 |
| 2006/0029411 | A1 * | 2/2006 | Ishii et al. | 399/67 |
| 2008/0302785 | A1 * | 12/2008 | Kinouchi et al. | 219/619 |

FOREIGN PATENT DOCUMENTS

| | | |
|---|---|---|
| JP | 6-318001 | 11/1994 |
| JP | 2001-125407 | 5/2001 |
| JP | 2003-107941 | 4/2003 |
| JP | 2006-120523 | 5/2006 |

* cited by examiner

*Primary Examiner* — David Porta
*Assistant Examiner* — Jessica L Eley
(74) *Attorney, Agent, or Firm* — Gerald E. Hespos; Michael J. Porco

(57) ABSTRACT

An image forming apparatus includes a fixing unit fixing a toner image onto a sheet. The fixing unit includes a heating member having a sheet conveyed region that is set in accordance with the size of the sheet. The fixing unit further includes a coil generating magnetic field, a fixed core forming a magnetic path, movable cores forming a magnetic path together with the fixed core and arranged along the sheet conveyed region, a shielding member arranged on at least one movable core and shielding magnetism, and a magnetism adjustment unit rotating at least one movable core to switch the position of the shielding member between a shielding position where the shielding member is positioned inside the sheet conveyed region to shield the magnetism and a retracted position where the shielding member is positioned outside the sheet conveyed region to permit pass of the magnetism.

9 Claims, 21 Drawing Sheets

L
W3
W2
W1
L1
L2
L3
A
B
158
158a
158b
158c
158d
159
159a
159b
159c
160

IMAGE FORMING APPARATUS

BACKGROUND OF THE INVENTION

1. Field of the Invention

The present invention relates to an image forming apparatus including a fixing unit which fixes a heated and melted unfixed toner onto a sheet carrying a toner image while passing the sheet of paper through a nip defined between a pair of heating rollers or a heating belt and a roller.

2. Description of the Related Art

In this type of image forming apparatus, in order to meet demands such as shortening the warm-up time of a fixing unit and saving energy, attention has recently been drawn to a belt method capable of operating with a smaller amount of heat capacity (e.g., refer to Japanese Patent Laid-Open Publication No. H06-318001). In recent years, an electromagnetic induction heating method (IH) capable of rapid heating or high-efficient heating has also been notable, and taking into account saving energy when fixing a color image, the image forming apparatus employing the combination of the electromagnetic induction heating and belt methods have been put on the market. The combination of the belt method and the electro-magnetic induction heating has advantages in that a coil can be easily laid out and cooled and a belt can be directly heated. These and other advantages prompt an electromagnetic inductor to be arranged outside of the belt (so-called external IH type).

In the electro-magnetic induction heating method, various arts have been developed for the purpose of preventing an excessive temperature rise in a non-sheet conveyed region in accordance with the width (conveyed-sheet width) of a sheet conveyed through a fixing unit. Particularly, a means for the different sizes of sheets in the external IH is described in the following prior arts, for example, Japanese Patent Laid-Open Publication No. 2003-107941 and Japanese Patent Laid-Open Publication No. 2006-120523).

In a first prior art (Japanese Patent Laid-Open Publication No. 2003-107941 (FIGS. 2 and 3)), a magnetic member is divided into several parts and arranged in a conveyed-sheet width direction, and some of the divided parts of the magnetic member are moved close to and apart from an excitation coil in accordance with the width (conveyed-sheet width) of a conveyed sheet. In this case, some of the divided parts of the magnetic member are moved apart from the excitation coil in a non-sheet conveyed region, thereby lowering the heat-generation efficiency in the non-sheet conveyed region to make the generated-heat quantity smaller than that in a minimum sheet conveyed region for a sheet of a minimum width.

In a second prior art (Japanese Patent Laid-Open Publication No. 2006-120523), a magnetic shielding plate having a curved-surface is formed in advance with a plurality of steps in the longitudinal directions thereof, and these steps form an area for passing magnetism and an area screening out magnetism in the width direction of a sheet. Therefore, when the size of a sheet is changed, the magnetic shielding plate is turned in accordance with the conveyed-sheet width, thereby screening out magnetism in a non-sheet conveyed region to suppress an excessive rise in the temperature of a heated roller or the like.

However, the first prior art has the problem of requiring a wider motion space for the magnetic member, thereby making the whole apparatus larger.

In the second prior art, the positions of the steps formed beforehand in the shielding plate determine the shielding area and the non-shielding area, thereby making it difficult to handle sheets of paper having many different sizes. Besides, if the steps are formed in the direction in which the shielding plate turns, then the turning angle as a whole is restricted to hinder enlarging each step (e.g., a turning angle of approximately 15°-30°), thereby reducing the quantity of screened-out magnetism and making it impossible to suppress the generated-heat quantity sufficiently.

SUMMARY OF THE INVENTION

It is an object of the present invention to provide an image forming apparatus capable of decreasing the number of members arranged inside a heating member to reduce the heat capacity, shorten the warm-up time and save a space, and also capable of regulating magnetism for a variety of sheet sizes and producing a shielding effect enough.

In order to accomplish the object, an image forming apparatus according to the present invention includes an image forming section forming a toner image and transferring the toner image onto a sheet and a fixing unit including a heating member and a pressure member. The fixing unit is operable to fix the toner image onto the sheet while nipping and conveying the sheet between the heating member and the pressure member. The heating member has a sheet conveyed region that the sheet passes. The sheet conveyed region is set in accordance with the size of the sheet being conveyed. The fixing unit further includes a coil arranged along an outer surface of the heating member and generating a magnetic field, a fixed core arranged opposite to the heating member with respect to the coil and forming a magnetic path, a plurality of movable cores arranged between the fixed core and the heating member with respect to a direction in which the coil generates a magnetic field, to form the magnetic path together with the fixed core, and also arranged along the sheet conveyed region, a shielding member arranged along an outer surface of at least one movable core and shielding magnetism, and a magnetism adjustment unit rotating at least one movable core around a predetermined axis to switch the position of the shielding member between a shielding position where the shielding member is positioned inside the sheet conveyed region to shield the magnetism and a retracted position where the shielding member is positioned outside the sheet conveyed region to permit pass of the magnetism.

These and other objects, features and advantages of the present invention will become more apparent upon reading of the following detailed description along with the accompanied drawings.

DETAILED DESCRIPTION OF THE PREFERRED EMBODIMENTS

Embodiments of the present invention will be described below in detail with reference to the drawings.

Figure 1:
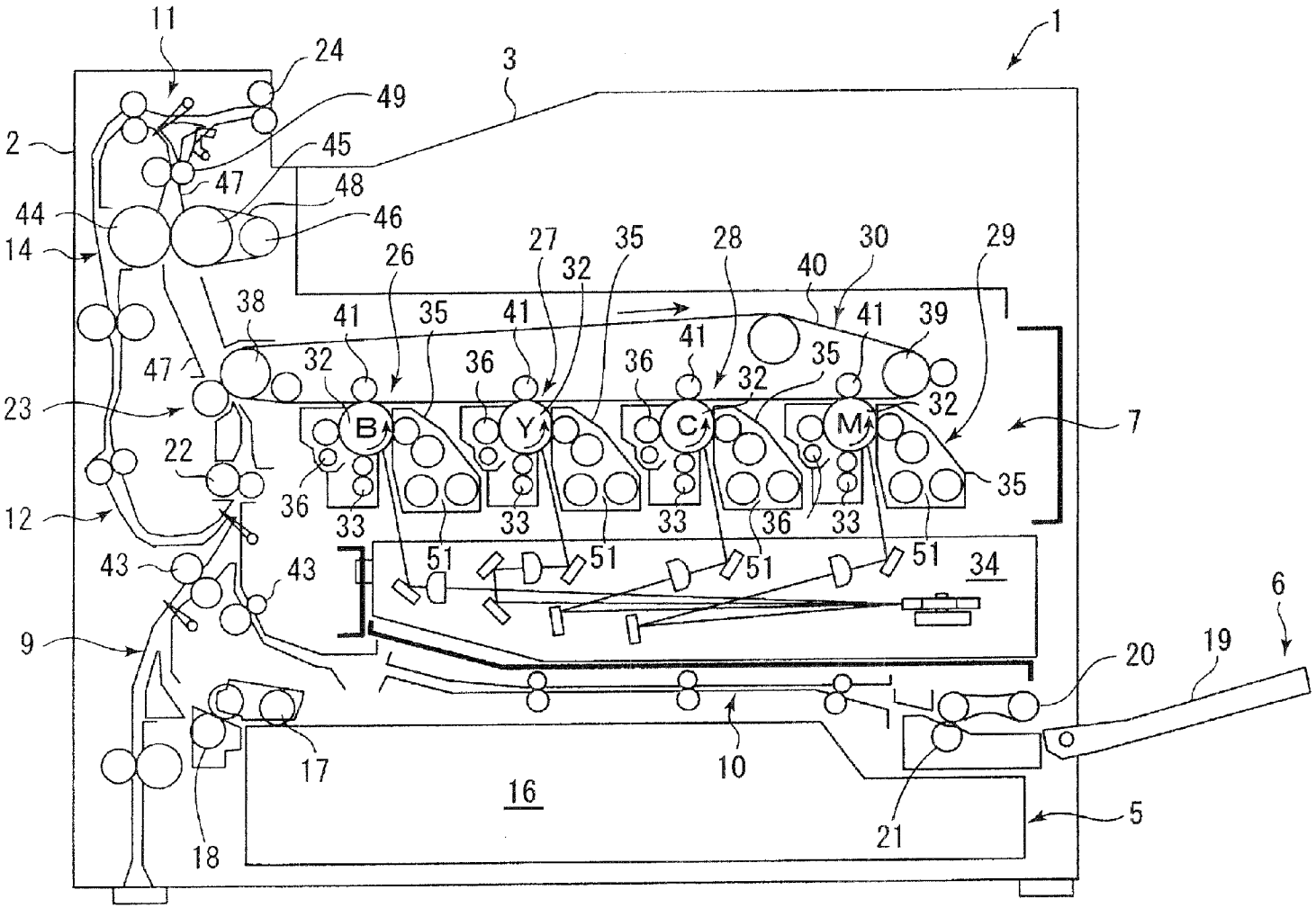
FIG. 1 is a schematic view showing a configuration of an image forming apparatus according to an embodiment of the present invention.

FIG. 1 is a schematic view showing a configuration of an image forming apparatus 1 according to an embodiment of the present invention. The image forming apparatus 1 conducts printing by transferring a toner image onto a surface of a printing medium such as printing paper according to image information and is, for example, a printer, a copying machine, a facsimile device, or a complex machine having some of the functions thereof.

The image forming apparatus 1 of FIG. 1 is a tandem-type color printer and includes an apparatus main body 2 shaped like a rectangular-parallelepiped box which forms (prints) a color image on a sheet inside thereof. The apparatus main body 2 is provided on the top with a paper discharge portion (discharge tray) 3 on which a sheet after a color image is printed thereon is discharged.

The apparatus main body 2 houses a paper cassette 5 storing sheets in a lower part thereof and is provided on a side (the right side in FIG. 1) with a stack tray 6 for manual feeding. Above the paper cassette 5, the apparatus main body 2 houses an image forming section 7 forming an image on a sheet based upon image data such as characters and pictures transmitted from the outside.

The apparatus main body 2 is provided inside at a left portion in FIG. 1 with a first conveying path 9 conveying to the image forming section 7 a sheet delivered from the paper cassette 5. Formed between the stack tray 6 and the first conveying path 9 is a second conveying path 10 which conveys a sheet delivered from the stack tray 6 to the image forming section 7. The apparatus main body 2 is provided inside at an upper-left portion with a fixing unit 14 which gives fixing to a sheet on which an image is formed in the image forming section 7, and a third conveying path 11 conveying a sheet to the paper discharge portion 3 after the fixing.

The paper cassette 5 can be drawn out of the apparatus main body 2 and then refilled with sheets, and includes a storage portion 16 selectively storing at least two kinds of sheets having different sizes. Sheets of paper stored in the storage portion 16 are delivered one by one to the first conveying path 9 by a sheet feeding roller 17 and a handling roller 18.

The stack tray 6 can be opened and closed on the right side of the apparatus main body 2 and includes a manual feeding portion 19 on which a single or a plurality of sheets are placed manually. Sheets placed on the manual feeding portion 19 are delivered one by one toward the second conveying path 10 by a pick-up roller 20 and a handling roller 21.

The first conveying path 9 and the second conveying path 10 join in front of a resist roller 22. A sheet supplied to the resist roller 22 waits once here, is sent to a secondary transfer portion 23 after undergoing a skew adjustment and a timing adjustment, and is given a secondary transfer of a full-color toner image on an intermediate transfer belt 40 in the secondary transfer portion 23. The sheet subjected to toner-image fixing in the fixing unit 14 is reversed, if necessary, in a fourth conveying path 12 and the side of the sheet reverse to the side subjected to the toner-image fixing undergoes the secondary transfer of a full-color toner image in the secondary transfer portion 23. After undergoing the toner-image fixing on the reverse side in the fixing unit 14, the sheet passes through the third conveying path 11 and is discharged to the paper discharge portion 3 by a discharge roller 24.

The image forming section 7 includes four image forming units 26 to 29 forming each toner image of black (B), yellow (Y), cyan (C) and magenta (M), and an intermediate transfer unit 30 superimposing and carrying toner images of each color formed by the image forming units 26 to 29.

Each of the image forming units 26 to 29 includes a photosensitive drum 32 rotating counterclockwise as shown by an arrow by a drive motor (not shown), a charger 33 mounted face to face with a peripheral surface of the photosensitive drum 32, a laser scanning unit 34 arranged downstream of the charger 33 in the rotational direction of the photosensitive drum 32 and applying a laser beam to a specified position on the peripheral surface of the photosensitive drum 32, a developer 35 arranged downstream of the laser-beam radiation position in the rotational direction of the photosensitive drum 32 and mounted face to face with the peripheral surface of the photosensitive drum 32, and a cleaner 36 arranged downstream from the developer 35 in the rotational direction of the photosensitive drum 32 and mounted face to face with the peripheral surface of the photosensitive drum 32.

Each developer 35 of the image forming units 26 to 29 includes a toner box 51 storing each of a black toner, a yellow toner, a cyan toner and a magenta toner.

The intermediate transfer unit 30 includes a rear roller (driving roller) 38 mounted near the image forming unit 26, a front roller (driven roller) 39 mounted near the image forming unit 29, the intermediate transfer belt 40 stretched between the rear roller 38 and the front roller 39, and four transfer rollers 41 pressed via the intermediate transfer belt 40 against the peripheral surface of the photosensitive drum 32 of each image forming unit 26 to 29.

In the intermediate transfer unit 30, toner images of each color are superimposed and transferred at the positions of the transfer rollers 41 from the photosensitive drums 32 onto the intermediate transfer belt 40, and a full-color toner image is formed on the intermediate transfer belt 40.

The first conveying path 9 conveys a sheet delivered from the paper cassette 5 to the intermediate transfer unit 30 and includes a plurality of conveying rollers 43 arranged in predetermined positions, and the resist roller 22 arranged in front of the intermediate transfer unit 30 and adjusting the timing between an image forming operation by the image forming section 7 and a paper feeding operation.

The fixing unit 14 heats and pressurizes a sheet, on which a toner image is transferred in the image forming section 7, to fix a toner image on the sheet. The fixing unit 14 includes, for example, a roller pair made up of a pressure roller 44 and a fixing roller 45 of a heating type. The pressure roller 44 has, for example, a metal core and an elastic surface layer (e.g., silicone rubber), and the fixing roller 45 has, for example, a metal core, an elastic surface layer (e.g., silicone sponge) and a mold-release layer (e.g., PFA). A heat roller 46 is arranged adjacent to the fixing roller 45, and a heating belt 48 is stretched between the heat roller 46 and the fixing roller 45. A specific structure of the fixing unit 14 will be further described later.

A conveying path 47 is formed on each of the upstream and downstream sides of the fixing unit 14 in the sheet conveying direction. Through the upstream conveying path 47, a sheet passed through the intermediate transfer unit 30 is introduced into the nip between the pressure roller 44 and the fixing roller 45, and through the nip, is guided to the third conveying path 11 via the downstream conveying path 47.

The third conveying path 11 forwards a sheet subjected to fixing in the fixing unit 14 to the paper discharge portion 3, and is provided in a proper position with a conveying roller pair 49 and at the outlet with the discharge roller 24.

First Embodiment

Details of Fixing Unit

Next, the fixing unit 14 of the image forming apparatus 1 according to a first embodiment of the present invention will be described in detail.

Figure 2:
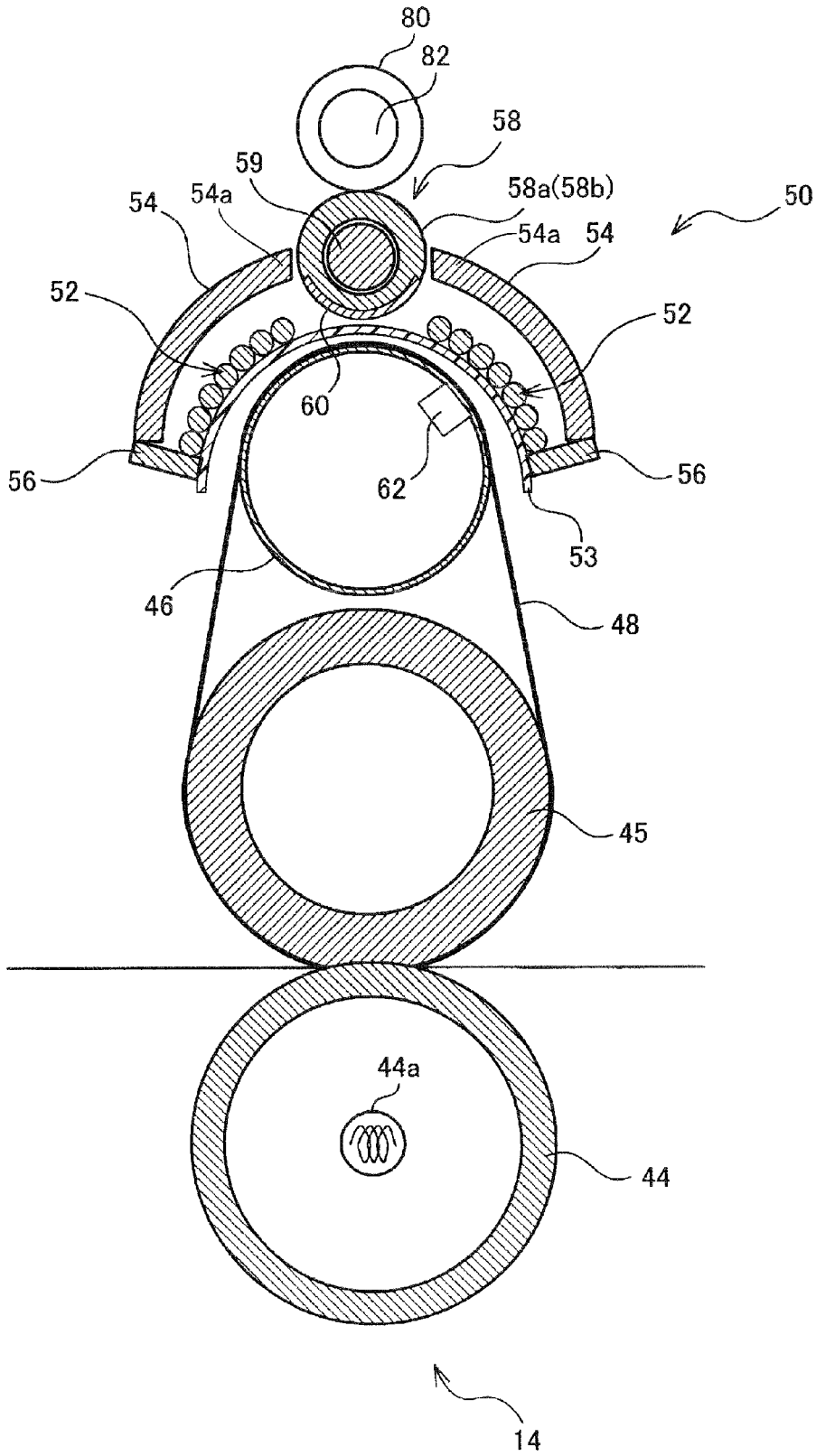
FIG. 2 is a longitudinal sectional view showing a structural example of a fixing unit.

FIG. 2 is a longitudinal sectional view showing a structural example of the fixing unit 14. In FIG. 2, the fixing unit 14 is shown with turned counterclockwise by approximately 90 degrees from a state thereof mounted in the image forming apparatus 1, and hence, the sheet conveying direction extends from right to left, though from below to above in FIG. 1. If the apparatus main body 2 is relatively large (complex machine or the like), the fixing unit 14 can be mounted in the direction given in FIG. 2, and in addition to the above, the fixing unit 14 may be arranged with inclined laterally from the state of FIG. 2.

As described above, the fixing unit 14 includes the pressure roller 44, the fixing roller 45, the heat roller 46 and the heating belt 48. The surface layer of the fixing roller 45 is formed with the elastic silicone sponge layer to form a flat nip between the heating belt 48 and the fixing roller 45.

The heating belt 48 includes a substrate made of a ferromagnetic material (e.g., Ni), a thin-film elastic layer (e.g., silicone rubber) formed in the surface layer of the substrate, and a mold-release layer (e.g., PFA) formed in the outer surface of the elastic layer. The heating belt 48 may be a resin belt such as PI if designed to have no heat-generation function. The heat roller 46 includes a metal core made of magnetic metal (e.g., Fe or SUS) and a mold-release layer (e.g., PFA) formed in the surface of the metal core.

The pressure roller 44 includes, for example, a metal core made of Fe and Al, a Si rubber layer formed on the metal core, and a fluororesin layer formed in the surface of the rubber layer. The pressure roller 44 may be provided inside with, for example, a halogen heater 44*a*.

The fixing unit 14 further includes an IH coil unit 50 (not shown in FIG. 1) arranged outward from the heat roller 46 and the heating belt 48. The IH coil unit 50 includes an induction heating coil 52, a pair of arch cores 54, a pair of side cores 56 and a center core 58.

[Coil]

In the example of FIG. 2, induction heating is conducted in the arcuate part of the heating belt 48 wound around the heat roller 46, and thereby, the induction heating coil 52 is arranged on an imaginary arcuate surface along the arcuate part of the heating belt 48. Further, the induction heating coil 52 extends along the longitudinal direction of the heat roller 46 and covers substantially the whole heat roller 46 in the longitudinal directions of the heat roller 46. In practice, a resinous bobbin 53 extending in the longitudinal direction of the heat roller 46 is arranged outward from the arcuate part of the heat roller 46, and the induction heating coil 52 is arranged in a winding shape on the bobbin 53. The bobbin 53 is molded into a semi-cylindrical shape conforming to the peripheral surface of the heat roller 46, and the material thereof may preferably be a heat-resistant resin (e.g., PPS, PET or LCP).

[Fixed Core]

As shown in FIG. 2, the center core 58 is in the middle, and the pair of arch cores 54 and the pair of side cores 56 are on both sides of the center core 58. The arch cores 54 are ferrite cores (fixed core) which are symmetrically molded in an arch-shape in section, and the full length thereof is greater than the length of the winding region of the induction heating coil 52. The side cores 56 are ferrite cores (fixed core) molded in a block-shape, and each side core 56 is connected to an end (lower end in FIG. 2) of the corresponding arch core 54 and covers the outside (lower part in FIG. 2) of the winding region of the induction heating coil 52. The arch core 54 is employed in a plural number. The arch cores 54 are arranged apart from each other in a plurality of places in the longitudinal direction of the heat roller 46 (refer to FIG. 3). The side cores 56 are arranged along the longitudinal directions of the heat roller 46 and have a full length corresponding to the length of the winding region of the induction heating coil 52.

The arrangement of the cores 54 and 56 is determined, for example, in accordance with the distribution of a magnetic-flux density (magnetic-field strength) of the induction heating coil 52. Although the arch cores 54 are arranged at predetermined intervals, the side cores 56 compensate for a magnetic-focusing effect in places where the arch cores 54 are not arranged, making the magnetic-flux density distribution (temperature difference) in the longitudinal direction of the heat roller 46 uniform. Outward from the arch cores 54 and the side cores 56, for example, a resinous core holder (not shown) is provided which supports the arch cores 54 and the side cores 56 and the material thereof may preferably be a heat-resistant resin (e.g., PPS, PET or LCP).

The heat roller 46 is provided inside with a thermistor 62 which can be arranged especially in a place where the heat roller 46 generates a large quantity of heat by induction heating. The thermistor 62 operates in response to an excessive temperature rise in the heat roller 46 to stop the heating conducted by the induction heating coil 52. Besides, a thermostat (not shown) can be provided inside the heat roller 46, improving the safety at the time of an abnormal temperature rise.

[Block-Shaped Core]

The center core 58 is, for example, a ferrite core having a cylindrical shape in section and a rotating-shaft member 59 is inserted through the center of the center core 58 in the axial direction of the center core 58. The rotating-shaft member 59 is formed from, for example, a non-magnetic metal (AL or the like) or a heat-resistant resin (PPS, PET, LCP or the like). The center core 58 is divided into a plurality of parts in the axial direction, and each part is formed as a block-shaped core 58*a* (movable core).

As can be seen in FIG. 2, a driving roller 80 and a driving motor 82 are provided above the center core 58 (on the opposite side to the heat roller 46). The driving roller 80 is, for example, formed on the surface with a rubber layer, and the outer peripheral surface of the driving roller 80 is in contact with one block-shaped core 58*a*. The rubber layer on the surface of the driving roller 80 is pressed into contact with the surface of the block-shaped core 58*a* with a moderate load by the elastic force of a spring (not shown) or the like. The driving roller 80 is rotated (driven) by the driving power of the driving motor 82, and this rotation leads the block-shaped core 58*a* in contact therewith to rotate with the friction force.

[Shielding Member]

The outer surface of each block-shaped core 58*a* is attached with a shielding member 60. The shielding member 60 is a thin plate member and is curved in an arcuate shape corresponding to the shape of the outer surface of the center core 58*a*. The shielding member 60 may be, as shown in the figure, for example, embedded in the block-shaped core 58*a*, or affixed to the outer surface of the block-shaped core 58*a*. The shielding member 60 can be affixed, for example, with a silicon adhesive.

It is preferable that the shielding member 60 is made of a non-magnetic and electrically-conductive material, such as oxygen-free copper. The shielding member 60 generates opposing magnetic field by the influence of induction current induced when a magnetic field perpendicular to a surface of the shielding member 60 penetrates the surface of the shielding member 60, and then cancel interlinkage flux (perpendicular penetrating magnetic field) to thereby shield the magnetic field. Further, by using a good electrically conductive material, the generation of Joule heat by the induction current is suppressed and the magnetic field can be efficiently shielded. In order to improve electrical conductivity, it is effective, for example, to select a material with as small a specific resistance as possible and to increase the thickness of the members. Specifically, it is preferable that the thickness of the shielding member 60 is greater than 0.5 mm. The thickness of the shielding member 60 is selected to be 1 mm in this embodiment.

The center core 58 is arranged between the arch cores 54 and the heat roller 46 (the heating belt 48) with respect to the direction of the magnetic-field generation by the induction heating coil 52 to form a magnetic path together with the arch cores 54 and the side cores 56. In detail, an end 54*a* (magnetic-path inlet or outlet) of the arch core 54 is apart from the heating belt 48, and the center core 58 is a member forming an intermediate magnetic path between the end 54*a* and the heating belt 48.

As shown in FIG. 2, if the shielding member 60 is in a position (shielding position) adjacent to the surface of the heating belt 48, the magnetic resistance rises around the induction heating coil 52 to lower the magnetic-field strength. On the other hand, if the block-shaped core 58*a* rotates (the direction is not especially limited) by 180 degrees from the state of FIG. 2 and the shielding member 60 is moved to a position (retracted position) farthest away from the heating belt 48, the magnetic resistance falls around the induction heating coil 52, leading formation of a magnetic path through the arch cores 54 and the heat roller 46 on both sides around the center core 58. As a result, the magnetic field works on the heating belt 48 and the heat roller 46.

[Details of Center Core]

Figure 3:
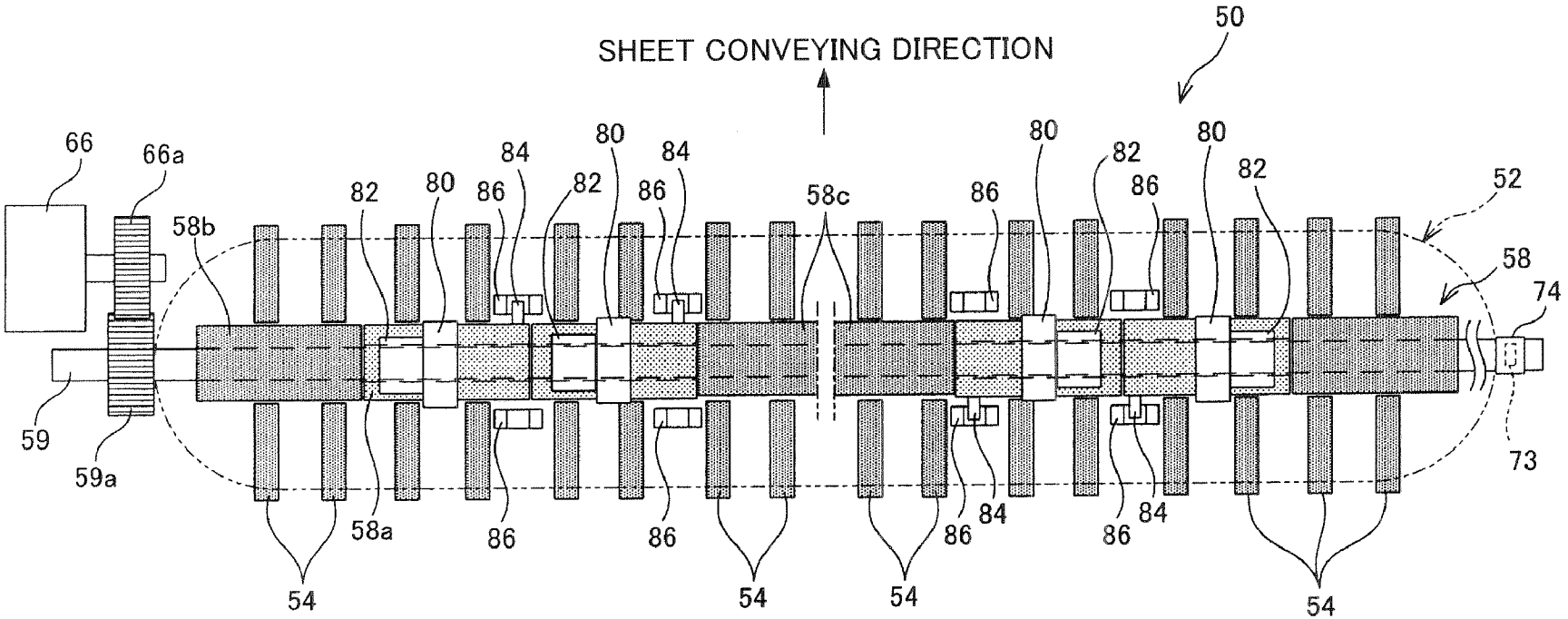
FIG. 3 is a plan view showing in detail a configuration of a center core divided in the axial direction.

FIG. 3 is a plan view showing in detail a configuration of a plurality of cores divided from the center core 58 in the axial direction. The center core 58 extends in a width direction orthogonal to the sheet conveying direction (shown by an arrow in FIG. 3), in other words, in the width direction of a sheet and has a full length slightly greater than a maximum conveyed-sheet width (e.g., the longitudinal length of A3 or the lateral length of A4). In this embodiment, the center core 58 includes four block-shaped cores 58*a*, two block-shaped cores 58*b* at both ends in the width direction, and one block-shaped core 58*c* in the middle in the width direction. The block-shaped cores 58*b* at both ends are each provided with the shielding member 60 while the block-shaped core 58*c* in the middle is not provided with the shielding member 60.

The block-shaped cores 58*a*, 58*b* and 58*c* are each arranged in a predetermined position in the sheet-width direction. The block-shaped core 58*c* may be divided into several core pieces in the axial direction if it is too large, thereby facilitating the manufacturing thereof.

[Cores at Both Ends and in the Middle]

The rotating-shaft member 59 penetrates the whole center core 58 and extends in the axial direction of the center core 58, and has a full length greater than the center core 58. Among the block-shaped cores 58*a*, 58*b* and 58*c*, two block-shaped cores 58*b* at both ends and the middle block-shaped core 58*c* in the width direction are fixed to the rotating-shaft member 59, and thereby, three block-shaped cores 58*b* and 58*c* are rotated together as the rotating-shaft member 59 rotates.

The IH coil unit 50 is provided with a driving motor 66 whose driving power rotates the rotating-shaft member 59. A driven gear 59*a* is attached to an end of the rotating-shaft member 59 and engaged with an output gear 66*a* of the driving motor 66. As the driving motor 66 is driven, the driving power rotates the rotating-shaft member 59, thereby rotating the three block-shaped cores 58*b* and 58*c* together.

[Independent Cores]

The four block-shaped cores 58*a* are all penetrated in the axial direction by the rotating-shaft member 59 and supported so as to be loosely rotated relative to the rotating-shaft member 59. Therefore, the driving motor 82 provided in each block-shaped core 58*a* is driven to rotate each block-shaped core 58*a* individually and independently.

Figure 4B:
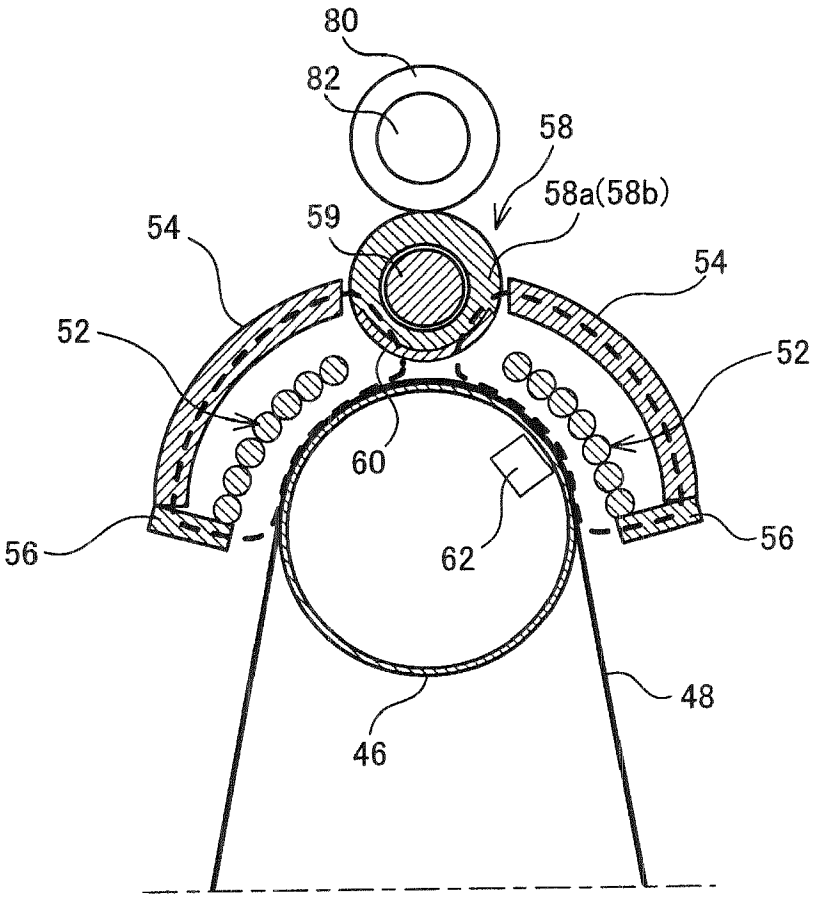
FIGS. 4A and 4B are longitudinal sectional views showing an operation as a block-shaped core rotates.
Figure 4A:
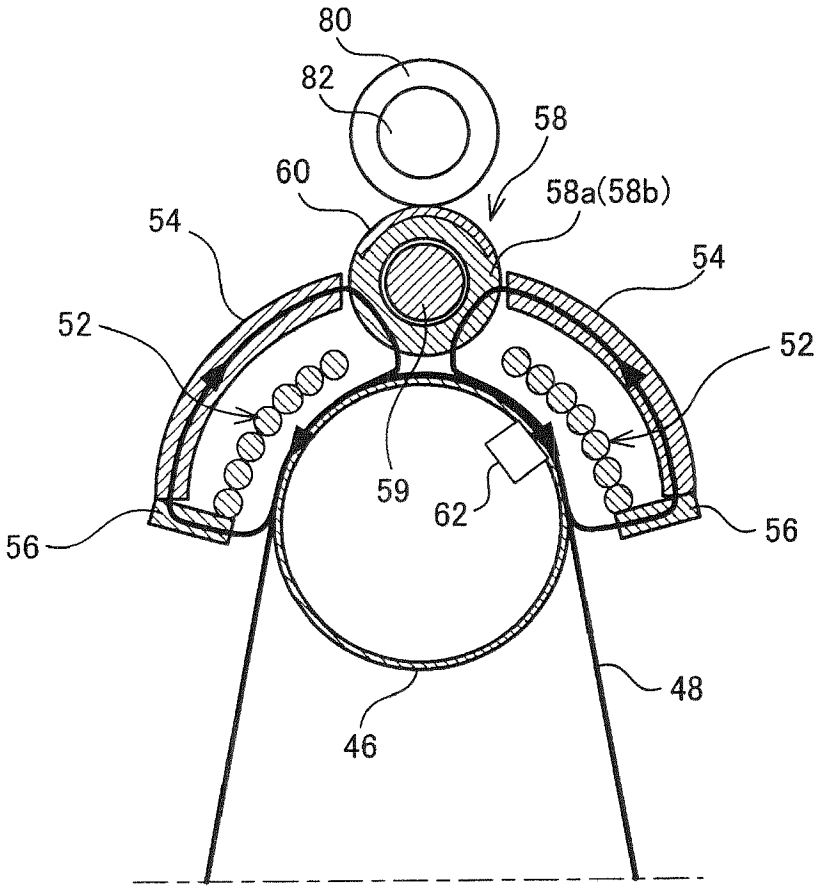

FIGS. 4A and 4B show an operation as the center core 58 (particularly, the block-shaped cores 58*a* and 58*b*) rotates, and each of them will be below described.

FIG. 4A shows an operation in the case where the shielding member 60 is switched to the retracted position as each block-shaped core 58*a*, 58*b* rotates. In this case, a magnetic field generated by the induction heating coil 52 passes the heating belt 48 and the heat roller 46 through the side cores 56, the arch cores 54 and each block-shaped core 58*a*, 58*b*. At this time, the ferromagnetic heating belt 48 and heat roller 46 cause an eddy current and generate Joule heat based on the specific resistance of each material, conducting heating.

FIG. 4B shows an operation in the case where the shielding member 60 is switched to the shielding position. In this case, the shielding member 60 of each block-shaped core 58*a*, 58*b* is located on a magnetic path in the width direction of the center core 58, thereby partly suppressing generation of a magnetic field. This suppresses the quantity of heat generated in the position of each block-shaped core 58*a*, 58*b*, preventing an excessive temperature rise in the heating belt 48 or the heat roller 46.

[Rotation Control Method]

Figure 5A:
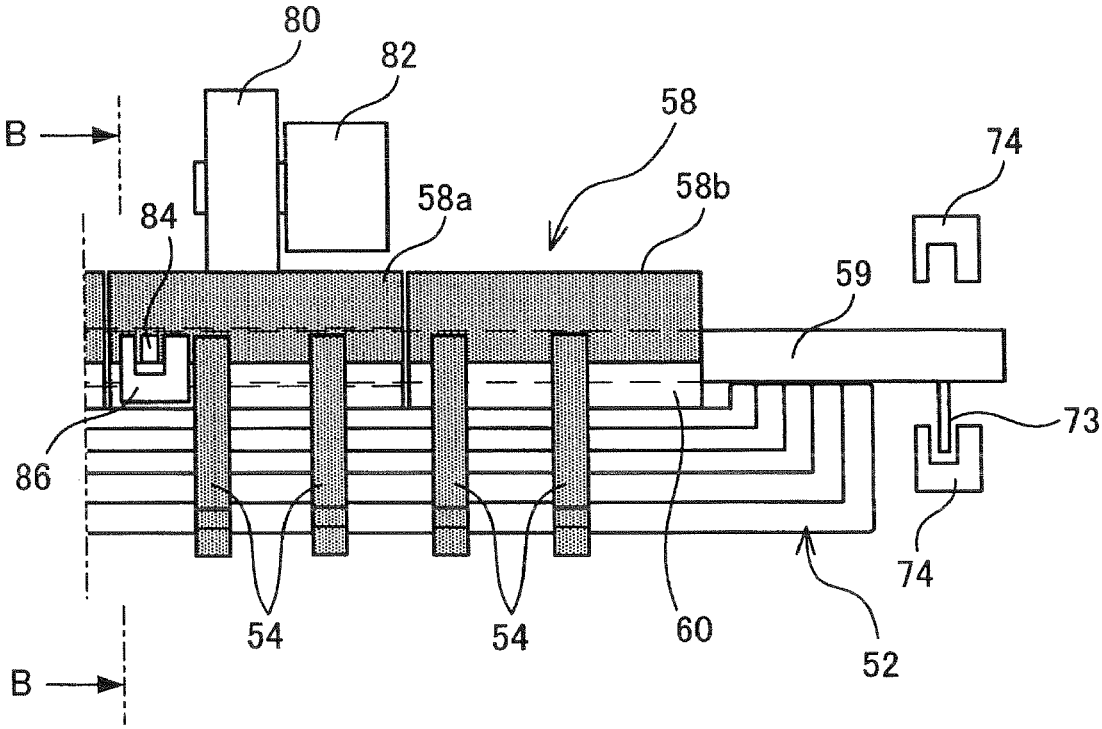
FIGS. 5A and 5B are a side view showing an end part of the center core and a partial sectional view (longitudinal section along a B-B line) showing an operation thereof, respectively.
Figure 5B:
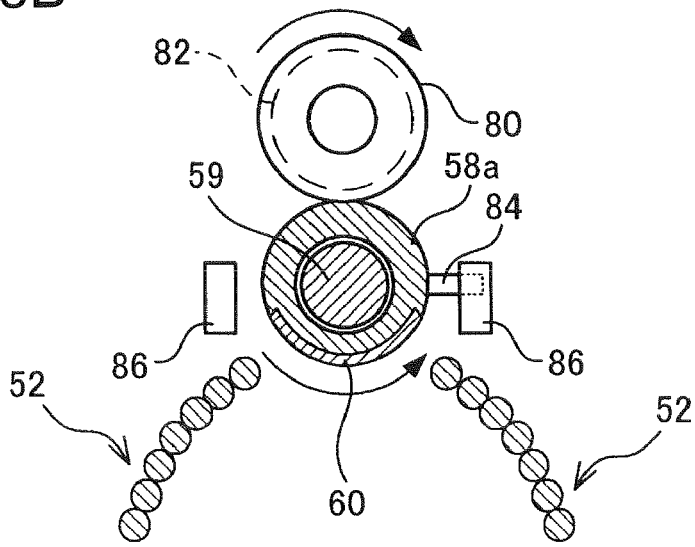

Next, a description will be given about a method of individually controlling the rotation of each block-shaped core 58*a*, 58*b*, 58*c* of the center core 58. FIGS. 5A and 5B are a side view showing one end of the center core 58 and a partial sectional view (longitudinal section along a B-B line in FIG. 5B) showing an operation thereof, respectively.

As shown in FIG. 5A, the rotating-shaft member 59 is provided at the other end with a position detecting member 73 protruding in a radial direction from the outer surface thereof, as well as two photo-interrupters 74 on both sides of the other end. In this embodiment, the stop position in which the driving motor 66 stops is controlled based upon a detection signal from the photo-interrupters 74 to rotate the block-shaped cores 58*b* and 58*c* at both ends and in the middle of the center core 58 by 180 degrees and switch the positions of the shielding members 60. The block-shaped core 58*c* in the middle is not provided with the shielding member 60, and in the block-shaped cores 58*b* at both ends, the positions of the shielding members 60 are switched. Each block-shaped core 58*a* is provided on the outer-circumference surface with a position detecting member 84 protruding in a radial direction from the outer peripheral surface.

As shown in FIG. 5B, the block-shaped core 58*a* is provided on both sides with photo-interrupters 86. On the basis of a detection signal from the photo-interrupters 86, the stop position in which each corresponding driving motor 82 stops is controlled to rotate each block-shaped core 58*a* individually by 180 degrees and switch the position (shielding position or retracted position) of the shielding member 60 separately.

The shielding position and the retracted position are mutually opposite positions 180 degrees apart from each other, and the shielding member 60 is moved to the shielding position or the retracted position by switching the rotation direction of the driving roller 80 in a forward and reverse manner. For example, as shown in FIG. 5B, if the block-shaped core 58*a* is rotated clockwise to move the shielding member 60 to the shielding position, the position detecting member 84 is detected by one photo-interrupter 86 and simultaneously the block-shaped core 58*a* is prevented from overrunning by the position detecting member 84. On the other hand, if the block-shaped core 58*a* is rotated counterclockwise to move the shielding member 60 to the retracted position, the position detecting member 84 is detected by the other photo-interrupter 86 and the block-shaped core 58*a* is prevented from overrunning by the position detecting member 84.

Each block-shaped core 58*a*, 58*b* is provided with two photo-interrupters 86, 74. Instead of this constitution, however, the shielding position of each block-shaped core 58*a*, 58*b* is set as a reference position and one photo-interrupter 86, 74 may be arranged in a position where the position detecting member 73, 84 is detected. In this case, the position in which each driving motor 82, 66 stops is controlled in such a way that the position where each block-shaped core 58*a*, 58*b* is rotated by 180 degrees from the reference position (shielding position) becomes the retracted position.

[Individual Control Circuit]

In this embodiment, each driving motor 66, 82 may be, for example, a stepping motor and the operation thereof is controlled by a control circuit (not shown). This control circuit can be formed, for example, by a control IC, an I/O driver, a semiconductor memory and the like. A detection signal from each photo-interrupter 74, 86 is inputted via the input driver to the control IC, and on the basis of detection signal, the control IC detects a present rotation angle (position) of each driving motor 66, 82. The control IC is notified of information on a present sheet size from an image forming control unit (not shown). Upon receiving the information, the control IC reads information on the position (shielding position or retracted position) of the shielding member 60 suitable for the sheet size from the semiconductor memory (ROM) and outputs a drive pulse equivalent to the rotation angle (180 degrees) corresponding to the position information at that time. The drive pulse is applied to each driving motor 66, 82 via the output driver to operate each driving motor 66, 82.

[Individual Control Example]

Next, a description will be given about the control of each block-shaped core 58*a*, 58*b*, 58*c* in accordance with the size of a sheet. In this embodiment, each block-shaped core 58*a*, 58*b*, 58*c* is designed in size to correspond to each conveyed-sheet width equivalent to, for example, the longitudinal length of A5, A4 or B4, or the lateral length of A4.

Figure 6A:
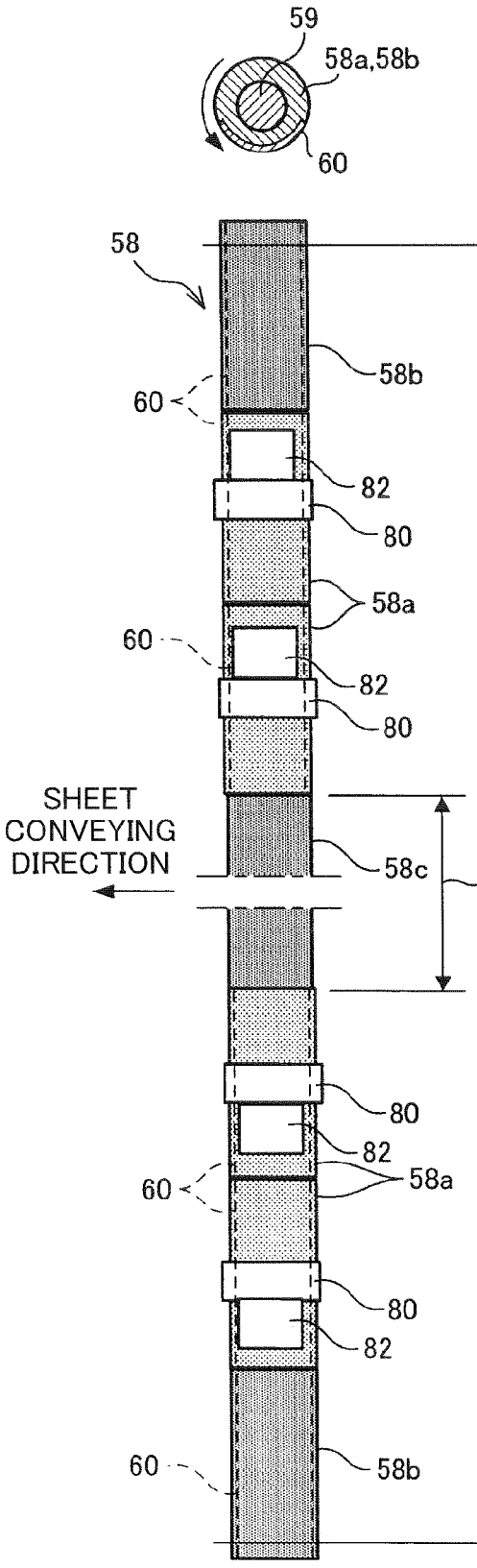
FIGS. 6A and 6B show a control example in accordance with each of a minimum conveyed-sheet width and a maximum conveyed-sheet width.
Figure 6B:
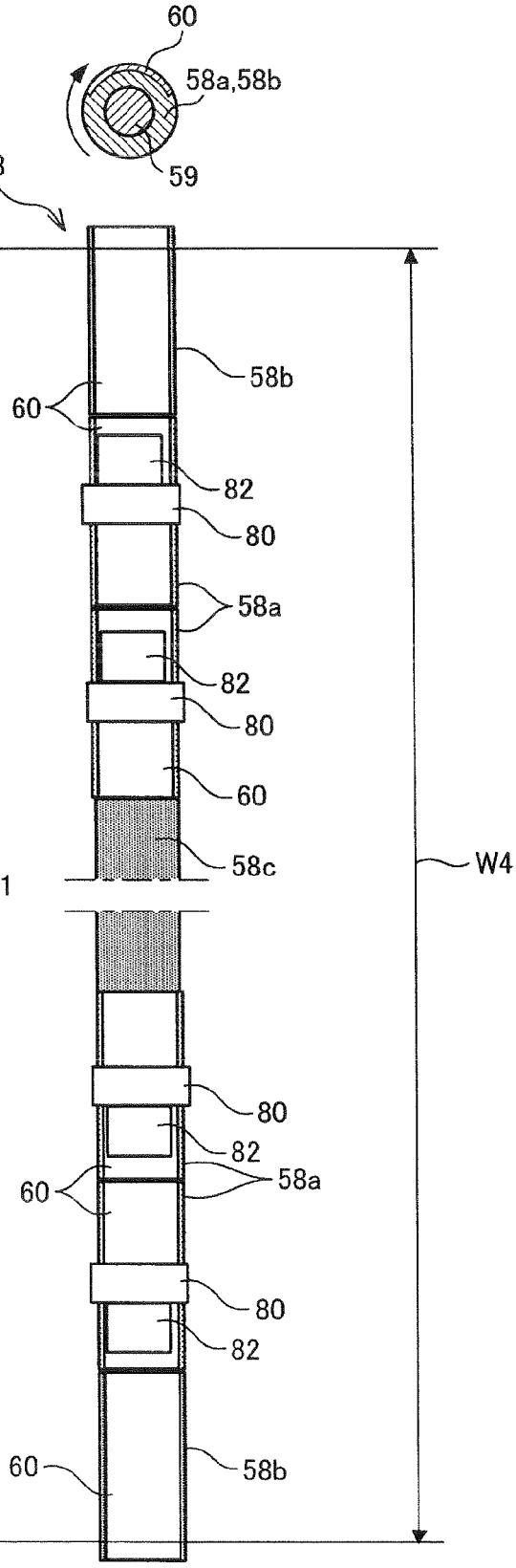

FIGS. 6A and 6B show a control example in accordance with each of a minimum conveyed-sheet width and a maximum conveyed-sheet width. The conveyed-sheet width denotes a sheet conveyed region where a sheet passes in accordance with the size of the sheet, particularly, the width orthogonal to a sheet-conveying direction. The outer surface of each block-shaped core 58*a*, 58*b*, 58*c* is given halftone dots. Each control example will be below described.

[Minimum Conveyed-Sheet Width]

As shown in FIG. 6A, when image formation is conducted with a minimum conveyed-sheet width W1 (e.g., the longitudinal length of A5), the stop positions (rotation angles) of the driving motors 66 and 82 are controlled with each shielding member 60 of the block-shaped cores 58*b* at both ends and the four block-shaped cores 58*a* switched to the shielding position. In this case, although the heat roller 46 is induction heated within the range of the minimum conveyed-sheet width W1, heat generation is suppressed outside the minimum conveyed-sheet width W1, preventing an excessive temperature rise in the heat roller 46.

[Maximum Conveyed-Sheet Width]

As shown in FIG. 6B, when image formation is conducted with a maximum conveyed-sheet width W4 (e.g., the lateral length of A4 or the longitudinal length of A3), the stop positions (rotation angles) of the driving motors 66 and 82 are controlled with each shielding member 60 of the block-shaped cores 58*b* at both ends and the four block-shaped cores 58*a* switched to the retracted position. In this case, the heat roller 46 is induction heated within the full range of the maximum conveyed-sheet width W4, and thereby, an image can be securely fixed on a sheet having a maximum size.

[Intermediate Conveyed-Sheet Width]

FIGS. 7A to 7G show a control example in accordance with an intermediate conveyed-sheet width. FIGS. 7B to 7G are each a sectional view along a B-B line to a G-G line of FIG. 7A. The following description shows an operation from the state shown in FIG. 6B.

Figure 7A:
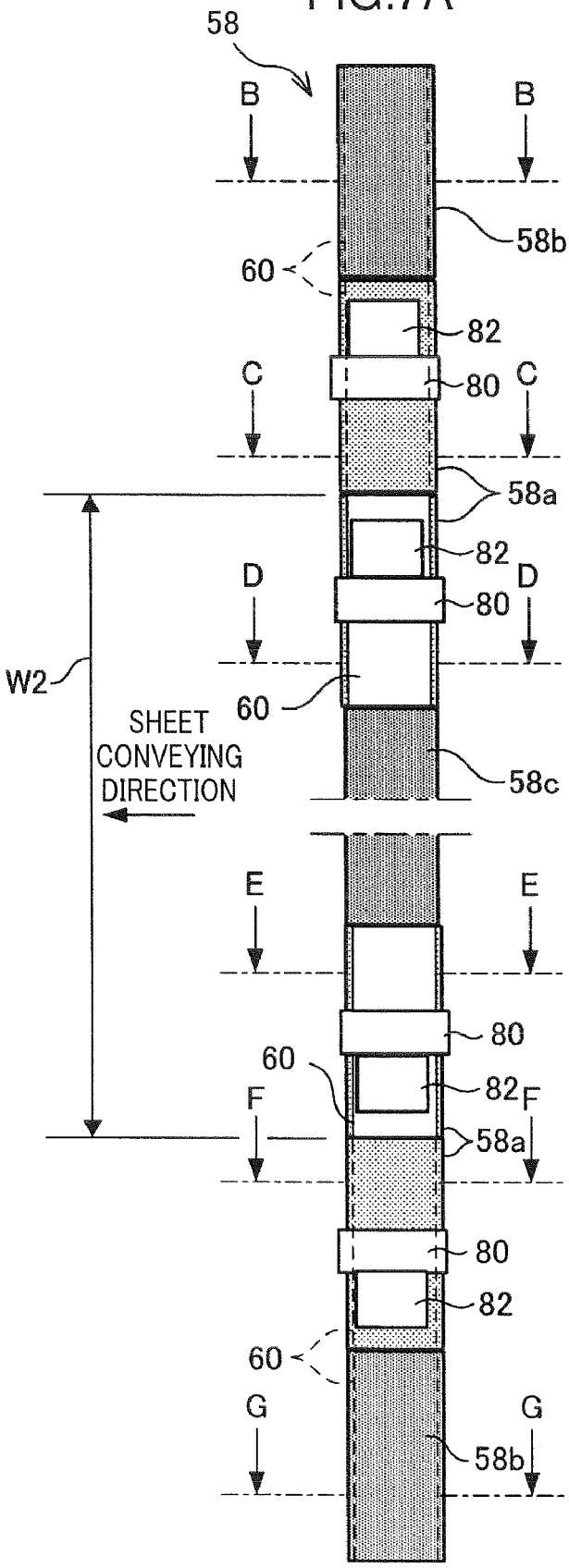
FIGS. 7A to 7G show a control example for an intermediate conveyed-sheet width.

As shown in FIG. 7A, when image formation is conducted with an intermediate conveyed-sheet width W2 (e.g., the longitudinal length of A4) one-size greater than the minimum conveyed-sheet width W1, the stop positions (rotation angles) of the driving motors 66 and 82 are controlled with each shielding member 60 of the block-shaped cores 58*b* at both ends and the two block-shaped cores 58*a* adjacent to the block-shaped cores 58*b* switched to the shielding position. Specifically, each will be below described.

[Cores at Both Ends]

Figure 7B:
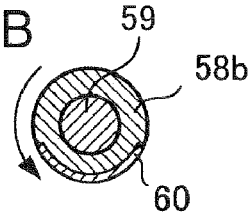
Figure 7C:
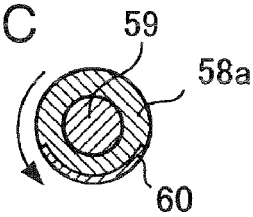
Figure 7D:
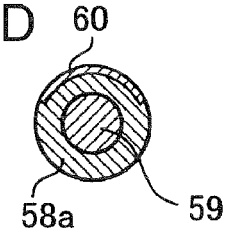
Figure 7E:
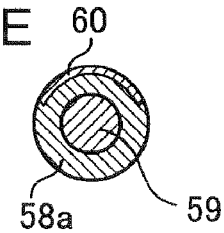
Figure 7F:
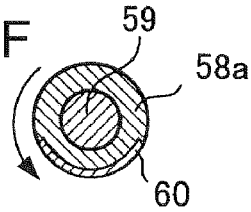
Figure 7G:
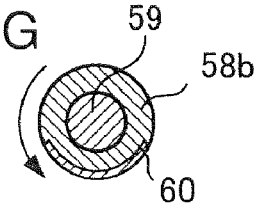

As shown in FIGS. 7B and 7G, the block-shaped cores 58*b* are rotated by 180 degrees together with the rotating-shaft member 59 by the drive of the driving motor 66 to thereby switch each shielding member 60 of the block-shaped cores 58*b* to the shielding position.

[Two Cores Near Both Ends]

As shown in FIGS. 7C and 7F, the block-shaped cores 58*a* adjacent to the block-shaped cores 58*b* are rotated by 180 degrees individually by the corresponding driving motor 82 to thereby switch the shielding members 60 to the shielding positions.

[Two Cores Near Middle]

As shown in FIGS. 7D and 7E, the two block-shaped cores 58*a* adjacent to the block-shaped core 58*c* in the middle of the center core 58 are kept in the retracted positions.

Next, FIGS. 8A to 8G show another control example in accordance with an intermediate conveyed-sheet width. FIGS. 8B to 8G are each a sectional view along a B-B line to a G-G line of FIG. 8A. The following description shows an operation from the state shown in FIG. 7.

Figure 8A:
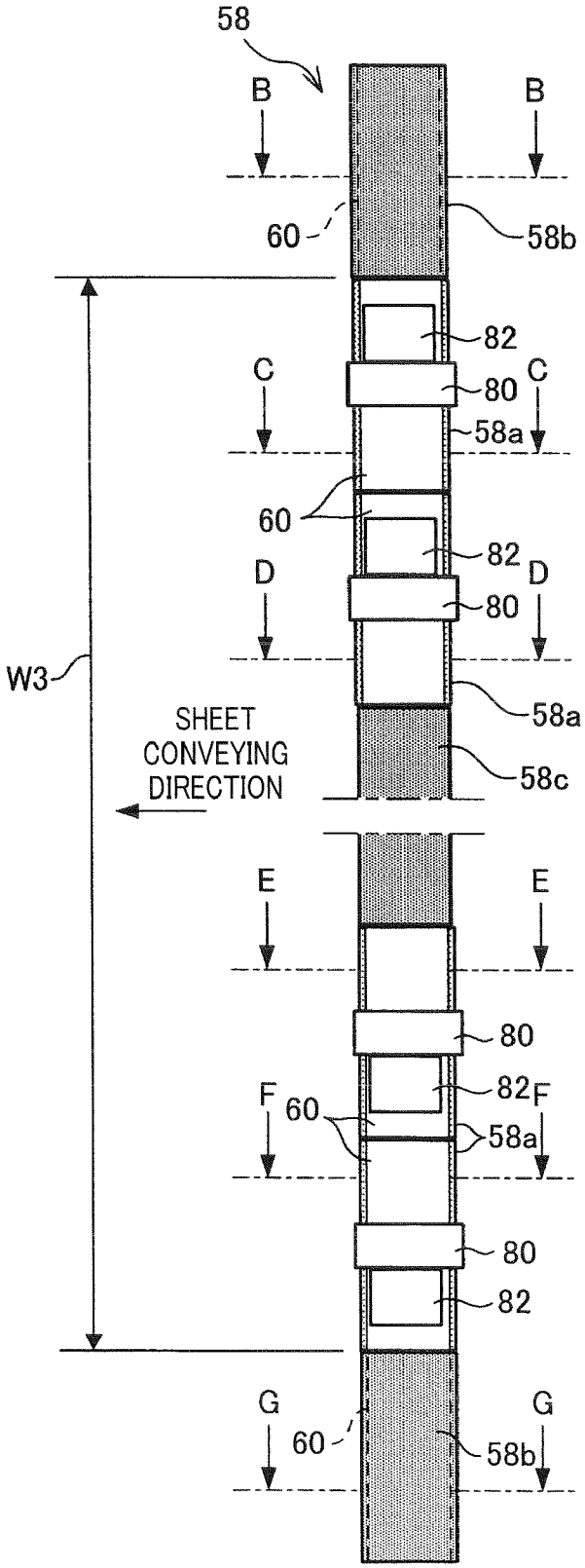
FIGS. 8A to 8G show a control example for a maximum conveyed-sheet width.

As shown in FIG. 8A, when image formation is conducted with an intermediate conveyed-sheet width W3 (e.g., the longitudinal length of B4) one-size greater than the intermediate conveyed-sheet width W2 and one-size smaller than the maximum conveyed-sheet width W4, the stop position (rotation angle) of the driving motor 66 is controlled in such a way that each shielding member 60 of the block-shaped cores 58*b* at both ends is switched to the shielding position, and the stop position (rotation angle) of each driving motor 82 is controlled in such a way that each shielding member 60 of the four block-shaped cores 58*a* is switched to the retracted position. Specifically, each will be below described.

[Cores at Both Ends]

Figure 8B:
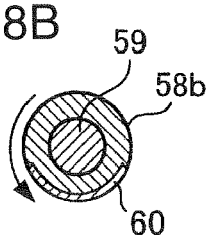
Figure 8C:
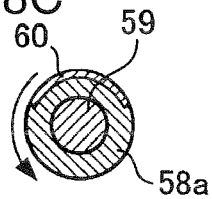
Figure 8D:
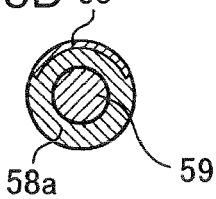
Figure 8E:
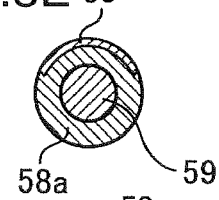
Figure 8F:
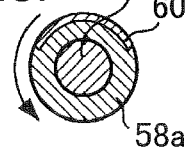
Figure 8G:
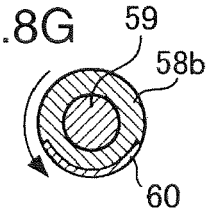

As shown in FIGS. 8B and 8G, the shielding members 60 of the block-shaped cores 58*b* at both ends of the center core 58 are kept in the shielding positions.

[Two Cores Near Both Ends]

As shown in FIGS. 8C and 8F, the block-shaped cores 58*a* adjacent to the two block-shaped cores 58*b* are rotated by 180 degrees individually by the corresponding driving motors 82 to thereby switch the shielding member 60 to the retracted position.

[Two Cores Near Middle]

As shown in FIGS. 8D and 8E, the two block-shaped cores 58*a* adjacent to the block-shaped core 58*c* in the middle of the center core 58 are kept in the retracted positions.

[Magnetism Adjustment Unit]

In this embodiment, the rotating-shaft member 59 supporting the block-shaped cores 58*b* and 58*c*, the driving motor 66 driving the rotating-shaft member 59, the driving roller 80 pressed into contact with each peripheral surface of the block-shaped cores 58*a* and the driving motor 82 driving the driving roller 80 constitute a magnetism adjustment unit capable of switching each shielding member 60 of the cores 58*a* and 58*b* between the shielding position and the retracted position. The magnetism adjustment unit individually rotates the four block-shaped cores 58*a* and independently controls the position (shielding position and retracted position) of each shielding member 60, thereby adjusting the quantity of screened-out magnetism optimally in accordance with the intermediate conveyed-sheet widths W2 and W3 of various types. This makes it possible to control the heated range of the heat roller 46 precisely in accordance with the size (conveyed-sheet width) of the sheet determined in advance and to prevent an excessive temperature rise certainly outside the conveyed-sheet width. In some of the above figures, although clockwise and counterclockwise rotations are each shown by an arrow, each block-shaped core 58*a*, 58*b* may be rotated only in one direction, and further, the sheet-conveying direction may be opposite to the direction shown in some of the figures.

[Other Structural Examples]

Figure 9:
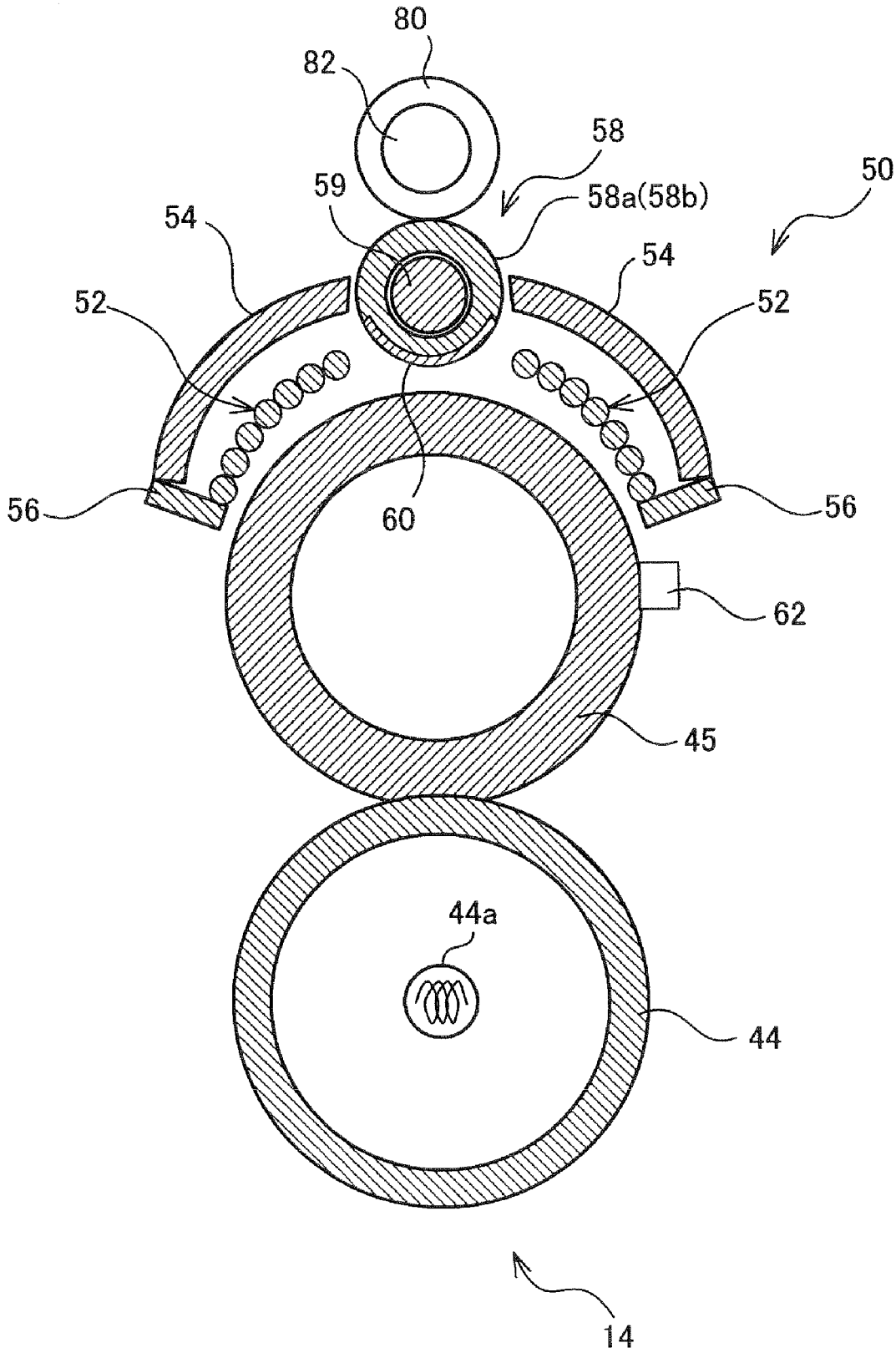
FIG. 9 is a longitudinal sectional view showing a further structural example of the fixing unit.

FIG. 9 shows a further structural example of the fixing unit 14 which fixes a toner image using the fixing roller 45 and the pressure roller 44 without any heating belt. For example, a magnetic body similar to the above heating belt is wound around the outer periphery of the fixing roller 45 and subjected to induction heating by the induction heating coil 52. In this case, the thermistor 62 is arranged outside the fixing roller 45 so as to face the magnetic-body layer. This structural example has the same as the above and is capable of managing changes in the size of a sheet by rotating each block-shaped core 58*a*, 58*b*.

Figure 10:
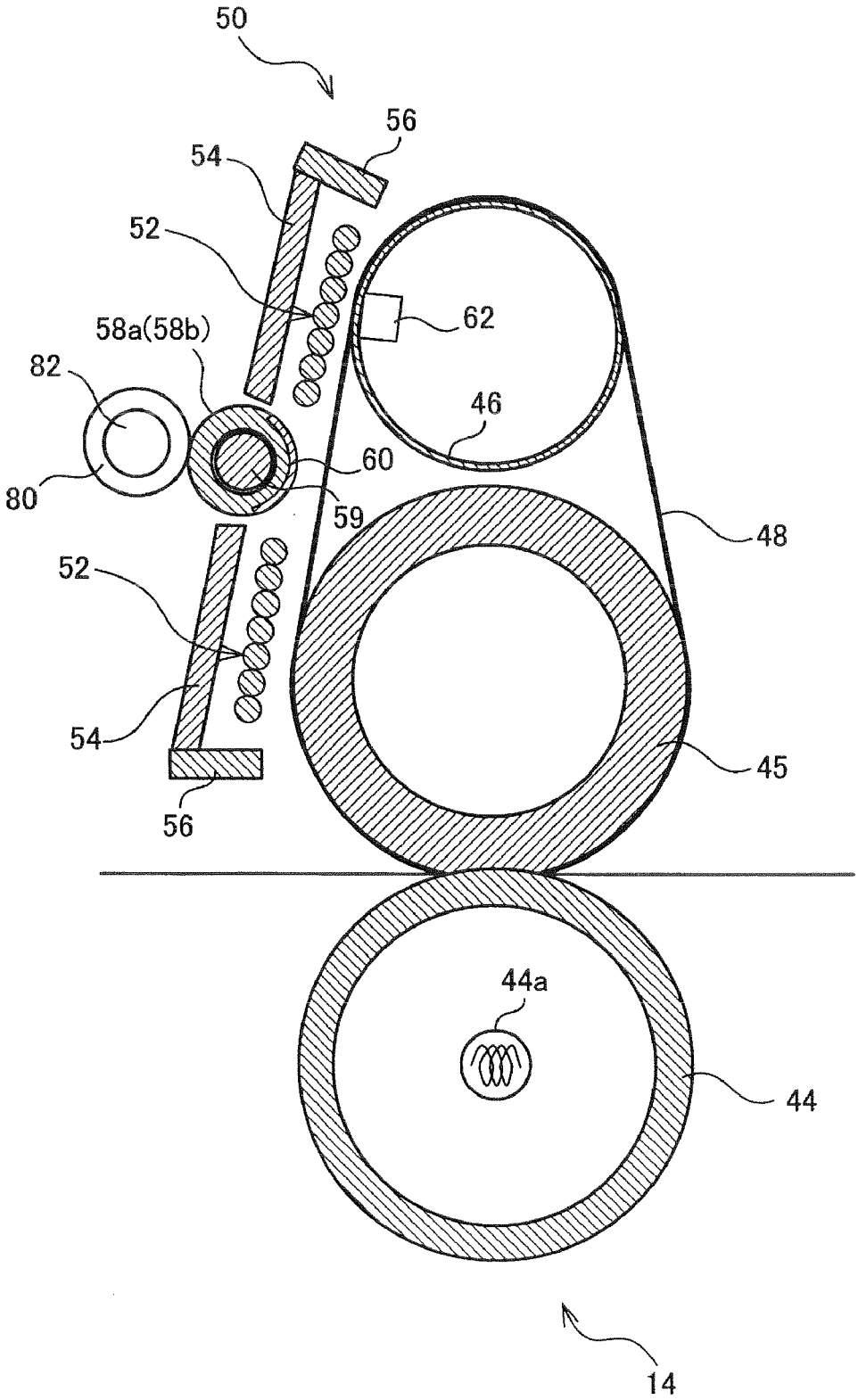
FIG. 10 is a longitudinal sectional view showing a still further structural example of an IH coil unit.

Next, FIG. 10 shows a further structural example of the IH coil unit 50 which conducts induction heating, not in the arcuate shape part of the heating belt 48, but in a flat part of the heating belt 48 between the heat roller 46 and the fixing roller 45. This structural example is also capable of managing changes in the size of a sheet by rotating each block-shaped core 58*a*, 58*b*.

Diverse variations are feasible in this embodiment. Each block-shaped core 58*a*, 58*b*, 58*c* has a cylindrical or columnar shape but is not limited to this, and hence, may have a polygonal shape in section. Further, the length of each block-shaped core 58*a*, 58*b*, 58*c* in the axial directions is not especially restricted, and hence, may be set suitably for the size of a sheet in use.

Besides, the specific form of each component element including the arch core 54 or the side core 56 is not limited to the one shown in the figures, and hence, may be properly variable.

Second Embodiment

Details of Fixing Unit

Next, the fixing unit 14 of the image forming apparatus 1 according to a second embodiment of the present invention will be described in detail.

Figure 11:
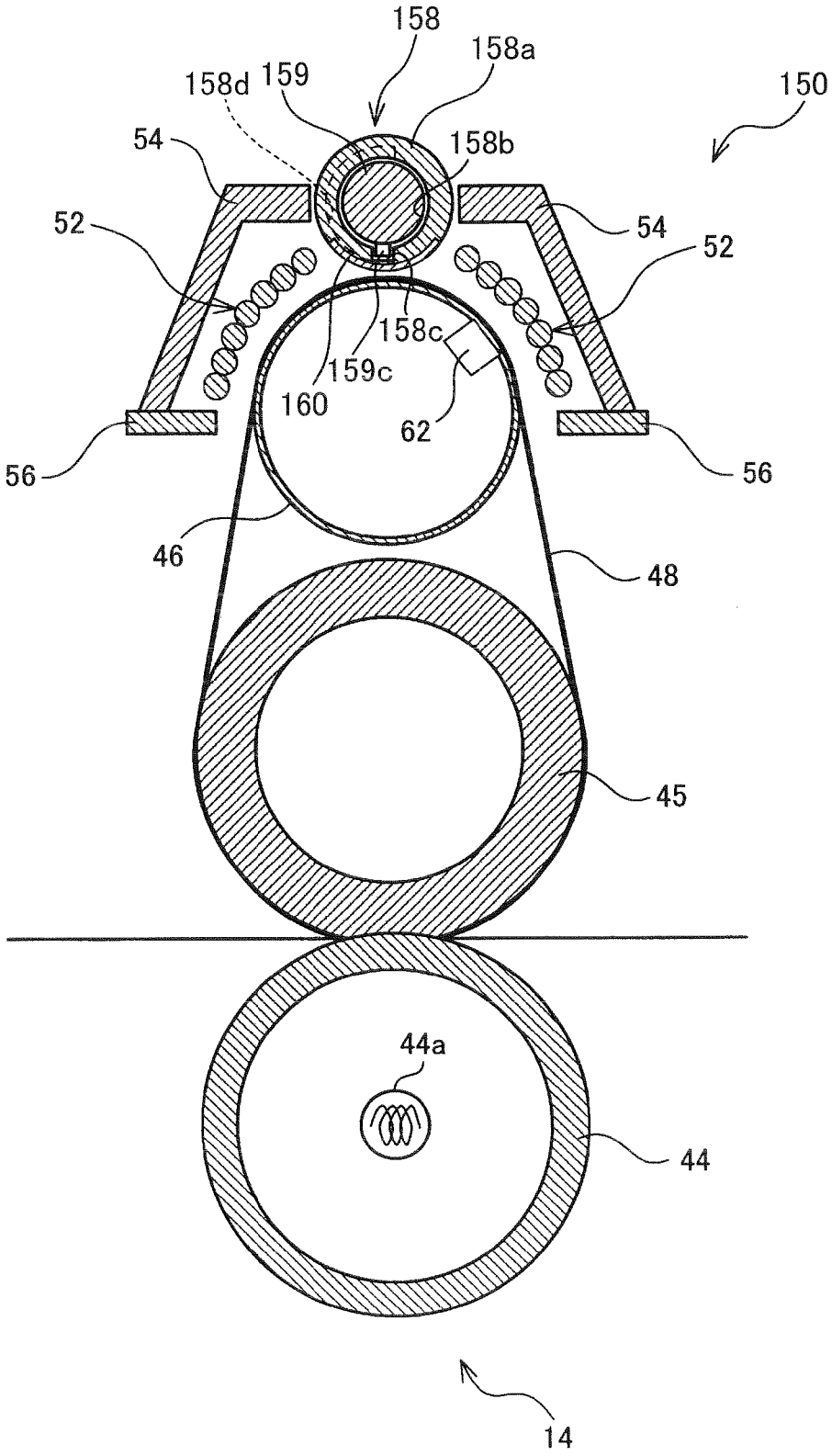
FIG. 11 is a longitudinal sectional view showing a structural example of a fixing unit.

FIG. 11 is a longitudinal sectional view showing the fixing unit 14 according to the second embodiment. In the same way as the first embodiment, the fixing unit 14 according to the second embodiment includes, as basic component elements thereof, the pressure roller 44, the fixing roller 45, the heat roller 46 and the heating belt 48. Hence, those members 44, 45, 46 and 48 are not described here.

The fixing unit 14 further includes an IH coil unit 150 outside the heat roller 46 and the heating belt 48. The IH coil unit 150 includes an induction heating coil 52, a pair of arch cores 54, a pair of side cores 56 and a center core 158. The induction heating coil 52, arch cores 54 and side cores 56 of the IH coil unit 150 have configurations substantially similar to the IH coil unit 50 according to the first embodiment, and hence, the description thereof is omitted. The center core 158 will be below described in detail.

[Center Core]

The center core 158 is, for example, a ferrite core having a cylindrical shape in section and includes a shaft member 159 inserted through the center thereof in the axial direction. The shaft member 159 is formed from, for example, a non-magnetic metal (AL or the like) or a heat-resistant resin (PPS, PET, LCP or the like). The center core 158 is divided into a plurality of parts to form a plurality of block-shaped cores 158*a*. The cores 158*a* are arranged in the axial direction of the center core 158.

[Shielding Member]

Each block-shaped core 158*a* has a shielding member 60 attached to the outer surface thereof. The shielding member 160 is a thin plate member and is curved in an arcuate shape conforming to the shape of the outer surface of the core 158*a*. The shielding member 160 may be, as shown in the figure, for example, embedded in the block-shaped core 158*a*, or affixed to the outer surface of the block-shaped core 158*a*. The shielding member 60 can be affixed, for example, with a silicon adhesive.

It is preferable that the shielding member 160 is made of a non-magnetic and electrically-conductive material, such as oxygen-free copper. In the shielding member 160, a magnetic field perpendicular to the surface thereof penetrates to cause an induced current and thereby generate a reverse magnetic field and cancel an interlacing magnetic flux (perpendicular penetration magnetic field), thereby screening out a magnetic field. Further, an electrically-conductive member is employed, thereby suppressing Joule heat generation caused by an induced current to screen out the magnetic field efficiently. In order to improve the electrical conductivity, for example, it is effective to select a material having a low specific resistance and thicken the member, and specifically, the thickness of the shielding member 160 may preferably be 0.5 mm or above, and for example, it is 1 mm in the second embodiment.

As shown in FIG. 11, if the shielding member 160 is in a position (shielding position) adjacent to the surface of the heating belt 48, the magnetic resistance rises around the induction heating coil 52 to lower the magnetic-field strength. On the other hand, if the block-shaped core 158*a* rotates (the direction is not especially limited) by 180 degrees and by the shielding member 160 is moved to a position (retracted position) farthest away from the heating belt 48, the magnetic resistance falls around the induction heating coil 52, leading formation of a magnetic path passing through the center core 158, the arch cores 54 and the heat roller 46 on both sides of the center core 158. As a result, the magnetic field works on the heating belt 48 and the heat roller 46.

[Details of Center Core]

Figures 12A, 12B, 12C, 12D, 12E:
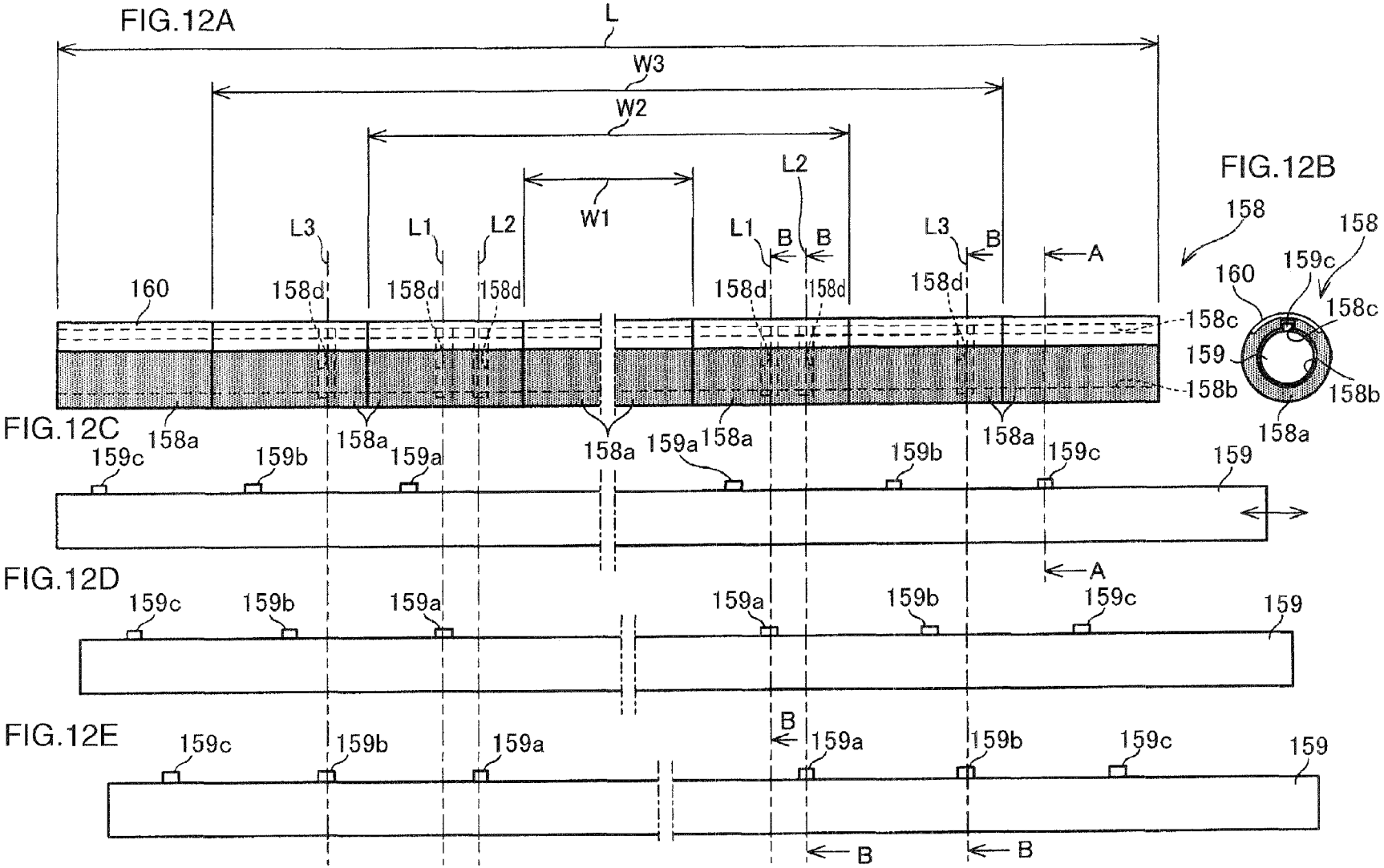
FIGS. 12A to 12E are plan views showing in detail a configuration of a center core divided in the axial direction.

FIGS. 12A to 12E are plan views showing in detail a configuration of the center core 158 divided in the axial direction. FIG. 12A and FIGS. 12C to 12E show a state in which the shaft member 159 is separated (extracted) from the center core 158. As is not shown in the figures, the center core 158 extends in the width direction of a sheet and has a full length (reference character L in FIG. 12A) greater than a maximum conveyed-sheet width (e.g., the longitudinal length of A3 or the lateral length of A4). If the longitudinal direction of the center core 158 shown in FIG. 12A is regarded as the axial direction (not shown), the axial direction corresponds to the sheet-width direction.

Although the block-shaped cores 158*a* arranged in the middle of the center core 158 in the axial direction are omitted in FIG. 12A, the center core 158 is divided into, for example, ten parts, in other words, ten block-shaped cores 158*a* form the center core 158. In FIG. 12A, all the block-shaped cores 158*a* are provided with the shielding members 160, but the middle block-shaped cores 158*a* arranged within a minimum conveyed-sheet width (W1 in the figures) may not be provided with the shielding member 160.

[Axial Groove]

As shown in FIGS. 12A and 12B, each block-shaped core 158*a* is formed with a through path 158*b* penetrating the inside thereof in the axial direction and having a circle-shape in section in the axial direction. The shaft member 159 is inserted through the through path 158*b* in the axial direction. Further, the inner-circumference surface of each block-shaped core 158*a* is formed with an axial groove 158*c* extending along the through path 158*b* in the axial direction. The axial groove 158*c* has a quadrilateral-shape in section when seen in the axial direction of the center core 158.

[Circumferential Groove]

Among the ten block-shaped cores 158*a*, some of the cores 158*a* has an inner peripheral surface formed with a circumferential groove 158*d* extending in the circumferential directions of each core 158*a*. In FIG. 12A, the circumferential groove 158*d* is formed in the second and third block-shaped cores 158*a* from both ends of the center core 158 in the axial direction of the center core 158. Specifically, the second block-shaped cores 158*a* from both ends are each formed with one circumferential groove 158*d* while the third block-shaped cores 158*a* from both ends are each formed with two circumferential grooves 158*d*. The circumferential groove 158*d* has a quadrilateral-shape in section when seen in the axial direction and extends over a predetermined angle (e.g., approximately 180 degrees) in the circumferential direction of the block-shaped core 158*a* from the axial groove 158*c*.

Figure 14:
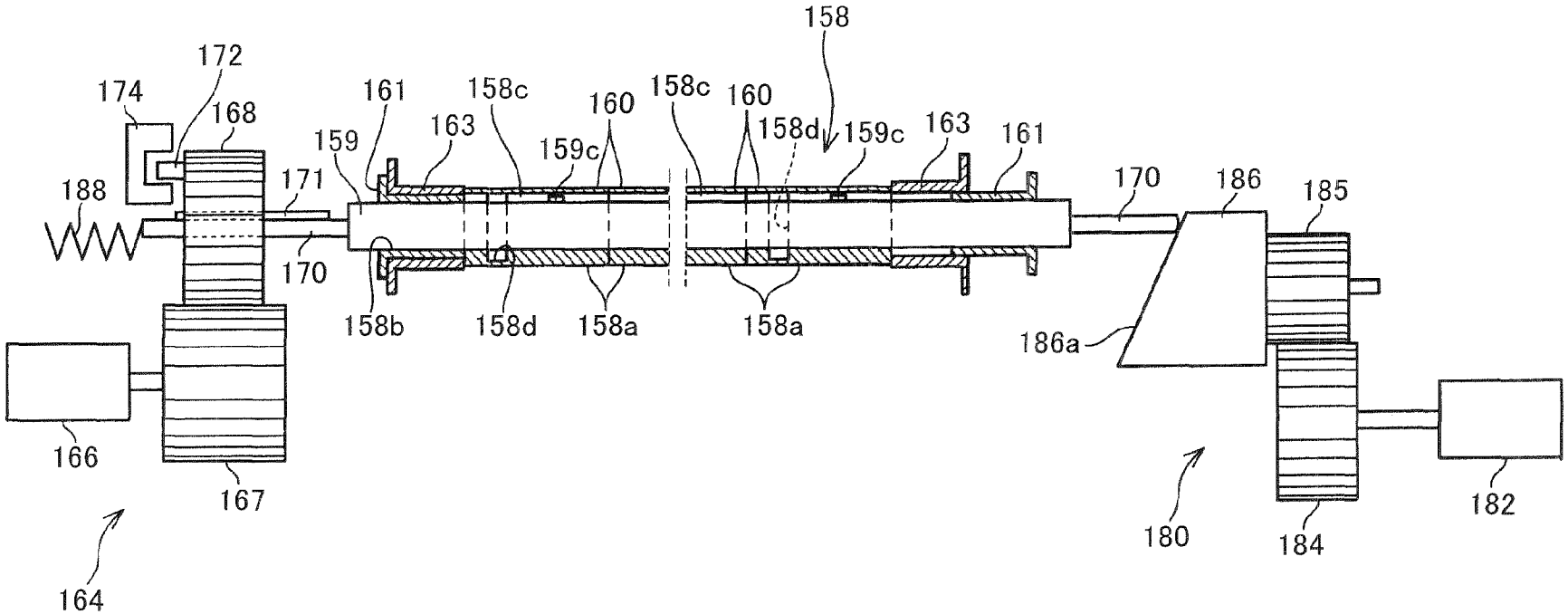
FIG. 14 is a side view showing a configuration of a rotation mechanism and a moving mechanism of the shaft member.

The shaft member 159 is shaped like a round bar and has a full length greater than that of the center core 158. The outer diameter of the shaft member 159 is slightly smaller than the inner diameter of the block-shaped core 158*a*, in other words, the diameter of the through path 158*b*, thereby enabling each block-shaped core 158*a* to rotate along the outer peripheral surface of the shaft member 159. The shaft member 159 can move or slide relative to the center core 158 (block-shaped core 158*a*) in the axial direction. The shaft member 159 is capable of moving in the axial direction by a moving mechanism 180 (FIG. 14) and rotating around the axial center by a rotation mechanism 164 (FIG. 14).

[Projection]

The shaft member 159 is provided on the outer peripheral surface with a plurality of projections 159*a*, 159*b* and 159*c* that are arranged at a predetermined interval and on the same line in the axial direction of the shaft member 159. The projections 159*a*, 159*b* and 159*c* have substantially the same shape and size.

The shape and size of each projection 159*a*, 159*b*, 159*c* are set in such a way that they can be received in the axial groove 158*c* and the circumferential groove 158*d*. Therefore, as shown in FIG. 12B, with the shaft member 159 inserted through the through paths 158*b*, all the projections 159*a*, 159*b* and 159*c* are received in the axial grooves 158*c*, thereby allowing the shaft member 159 to move in the axial direction relative to the block-shaped cores 158*a* inside of the through paths 158*b*.

If the shaft member 159 is rotated relative to the block-shaped cores 158*a* with any of the projections 159*a*, 159*b* and 159*c* aligned in the axial direction with the circumferential groove 158*d*, the projections 159*a*, 159*b* and 159*c* are received into the circumferential groove 158*d* and moved in the circumferential direction along the circumferential groove 158*d*.

[Magnetism Adjustment Method]

Each shielding member 160 of the block-shaped cores 158*a* is switched from the retracted position to the shielding position in accordance with the size of a sheet to be printed. In FIGS. 12A and 12B, the shielding members 160 are in the retracted positions, and if each block-shaped core 158*a* is rotated by 180 degrees around the axial center, the shielding members 160 are moved from the retracted positions to the shielding positions shown in FIG. 11.

When the block-shaped core 158*a* is required to have the shielding member 160 switched to the shielding position, the shaft member 159 is rotated with the projection 159*a*, 159*b* or 159*c* received in the axial groove 158*c* to thereby rotate the block-shaped core 158*a* together with the shaft member 159. On the other hand, when the block-shaped core 158*a* is not required to have the shielding member 160 switched to the shielding position, the shaft member 159 is rotated with the projection 159*a*, 159*b* or 159*c* received in the circumferential groove 158*d*. In this case, since the projection 159*a*, 159*b* or 159*c* moves along the circumferential groove 158*d*, the block-shaped core 158*a* is not rotated (or idled) even if the shaft member 159 is rotated. A description will be below given about a switch from the retracted position to the shielding position in accordance with the size of a sheet.

[Minimum Sheet-Conveyed Region W1]

As shown in FIG. 12C, when the size of a sheet is minimum (e.g., the longitudinal length of A5), all the six block-shaped cores 158*a* on both outsides of a minimum sheet conveyed region W1 are rotated, executing control in such a way that the shielding members 160 switch from the retracted positions to the shielding positions. Specifically, the shaft member 159 is moved in the axial direction to bring the projections 159*a*, 159*b* and 159*c* to positions where they do not align with the circumferential grooves 158*d*. If the shaft member 159 is rotated in this state, each projection 159*a*, 159*b*, 159*c* is rotated while being hooked in the axial groove 158*c*, thereby rotating all the six block-shaped cores 158*a* outside the minimum sheet conveyed region W1.

[Intermediate Sheet Conveyed Region W2]

As shown in FIG. 12D, when the size of a sheet is intermediate (e.g., the longitudinal length of A4), the four block-shaped cores 158*a* on both outsides of an intermediate sheet conveyed region W2 are rotated, executing control in such a way that the shielding members 160 switch from the retracted positions to the shielding positions. Specifically, the shaft member 159 is moved in a predetermined direction (rightward in FIG. 12C) from the position shown in FIG. 12C to bring the circumferential grooves 158*d* of the two block-shaped cores 158*a* inside the intermediate sheet conveyed region W2 and the projections 159*a* on the same lines (L1 in the figure) perpendicular to the axial center. If the shaft member 159 is rotated in this state, the four projections 159*b* and 159*c* are rotated while being hooked in the axial grooves 158*c* whereas the two projections 159*a* are moved along the circumferential grooves 158*d* without being hooked in the axial grooves 158*c*. As a result, only the four block-shaped cores 158*a* outside the intermediate sheet conveyed region W2 are rotated while the other block-shaped cores 158*a* inside the intermediate sheet-conveyed region w2 are not rotated.

[Maximum Sheet Conveyed Region W3]

Figure 13A:
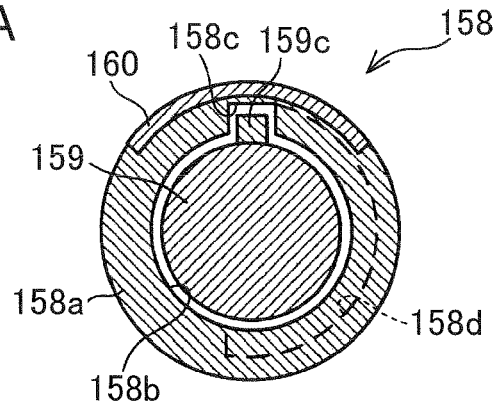
FIGS. 13A to 13D are vertical sectional views showing a rotation or non-rotation state of a block-shaped core as a shaft member rotates.
Figure 13B:
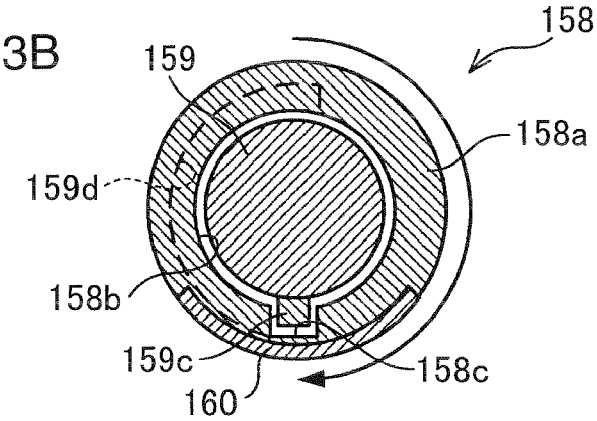
Figure 13C:
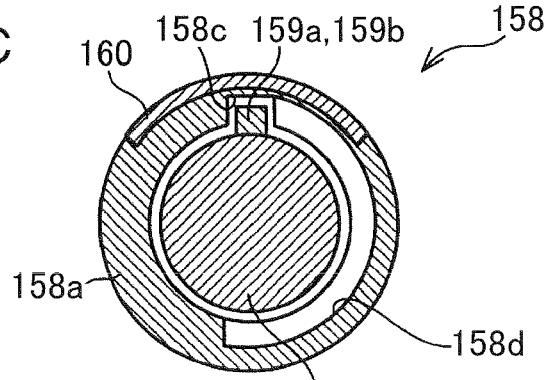
Figure 13D:
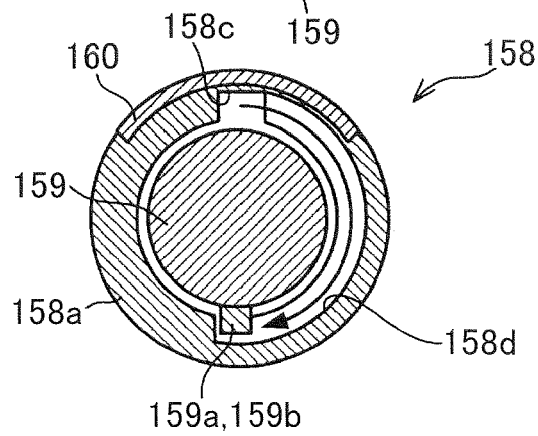

As shown in FIG. 12E, when the size of a sheet is maximum (e.g., the lateral length of A4), only the two block-shaped cores 158*a* on both outsides (at both ends of the center core 158) of a maximum sheet conveyed region W3 are rotated, executing control in such a way that the shielding members 160 switch from the retracted positions to the shielding positions. Specifically, the shaft member 159 is further moved rightward from the position shown in FIG. 12D to bring the circumferential grooves 158*d* of the two block-shaped cores 158*a* (the third cores 158*a* from both ends of the center core 158) near the middle inside of the maximum sheet conveyed region W3 and the projections 159*a* on the same lines (L2 in the figure) and also to bring the circumferential grooves 158*d* of the two block-shaped cores 158*a* (the second center cores 158*a* from both ends of the core 158) and the projections 159*a* on the same lines (L3 in the figure). If the shaft member 159 is rotated in this state, the two projections 159*c* are each hooked in the axial groove 158*c* of the outermost core 158*a* while the four projections 159*a* and 159*b* are moved along the circumferential grooves 158*d* without being hooked in the axial grooves 158*c*. As a result, only the two block-shaped cores 158*a* outside the maximum sheet conveyed region W3 are rotated while the other block-shaped cores 158*a* are not rotated. FIGS. 13A to 13D are vertical sectional views showing a rotation or non-rotation state of the block-shaped core 158*a* as the shaft member 159 rotates. FIGS. 13A and 13B are sectional views along an A-A line of FIG. 12, and FIGS. 13C and 13D are sectional views along a B-B line of FIG. 12.

[Switch to Shielding Position]

As shown in FIG. 13A, the shaft member 159 can move in the axial direction with the projection 159*c* received in the axial groove 158*c*, and with respect to the rotation direction, the projection 159*c* is hooked in the axial groove 158*c*.

As shown in FIG. 13B, if the shaft member 159 is, for example, rotated clockwise by 180 degrees, the block-shaped core 158*a* is rotated together with the shaft member 159 by the projection 159*c* received in the axial groove 158*c*, thereby switching the shielding member 160 from the retracted position to the shielding position. The shielding member 160 can be returned from the shielding position to the retracted position by rotating the shaft member 159 reversely by 180 degrees.

[Keeping in Retracted Position]

As shown in FIG. 13C, if the projections 159*a* and 159*b* are aligned with the circumferential grooves 158*d*, the projections 159*a* and 159*b* are unhooked from the cores 158*a*.

As shown in FIG. 13D, if the shaft member 159 is, for example, rotated clockwise by 180 degrees, the projections 159*a* and 159*b* only move in the circumferential direction in the circumferential grooves 158*d* and the block-shaped cores 158*a* are not rotated together, thereby keeping the shielding member 160 in the retracted position. In this state, even if the shaft member 159 is reversely rotated by 180 degrees, each projection 159*a*, 159*b* moves reversely in the circumferential groove 158*d* and merely returns into the axial groove 158*c* to keep the block-shaped core 158*a* unturned.

[Rotation Mechanism, Moving Mechanism]

Figure 15:
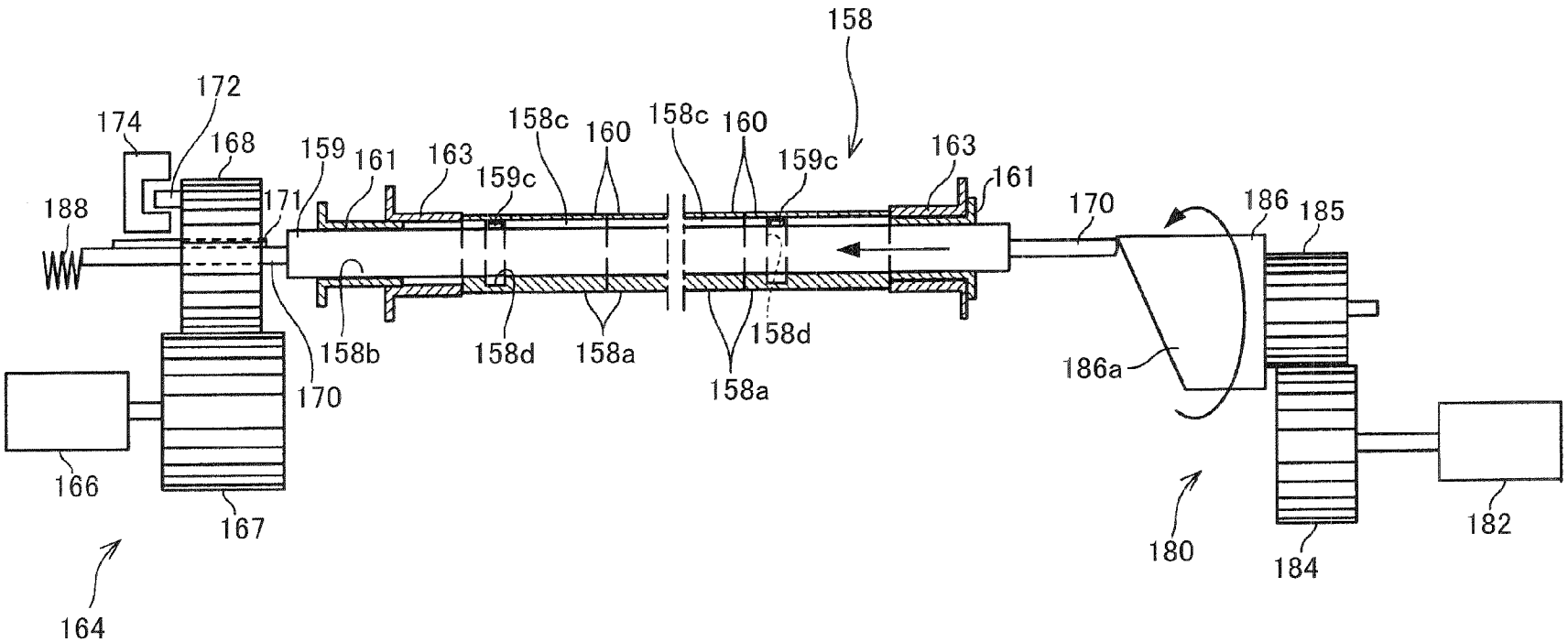
FIG. 15 is a side view showing the configuration of the rotation mechanism and the moving mechanism of the shaft member.

Next, a configuration will be described for rotating or moving the shaft member 159. FIGS. 14 and 15 are each a side view showing a configuration of the rotation mechanism 164 and the moving mechanism 180 of the shaft member 159, and in FIG. 14, the center core 158 is shown in a longitudinal section.

The rotation mechanism 164 rotates the shaft member 159, for example, by transmitting the rotation of a stepping motor 166 via gears 167 and 168 to drive a drive shaft 170. In order to detect a rotation position (reference position in the rotation direction) of the shaft member 159, the gear 168 is provided on a side thereof with an index 172 and a photo-interrupter 174 combined therewith.

The drive shaft 170 is integrally connected with the shaft member 159 and has the same axial center as those of the shaft member 159 and the center core 158. The rotation angle (switch between the retracted position and the shielding position) of the shaft member 159 can be controlled, for example, with a drive-pulse number applied to the stepping motor 166, and the rotation mechanism 164 has a control circuit (not shown) for this purpose. The control circuit can be formed, for example, by a control IC, an I/O driver, a semiconductor memory and the like. A detection signal from the photo-interrupter 174 is inputted via the input driver to the control IC, and on the basis of the detection signal, the control IC can detect the shaft member 159 being in the reference position or not. In the second embodiment, the shielding member 160 stops in the retracted position as the shaft member 159 stops in the reference position, and the shielding member 160 is switched from the retracted position to the shielding position as the shaft member 159 is rotated by 180 degrees from the reference position.

The moving mechanism 180 moves the shaft member 159 in the axial direction through the drive shaft 170, for example, by transmitting the mechanical power of a stepping motor 182 via gears 184 and 185 to rotate a swash plate cam 186 which in turn drives the drive shaft 170. The swash plate cam 186 is formed with a cam plane 186*a* inclined with respect to an axial line thereof, and an end of the drive shaft 170 is in contact with the cam plane 186*a* to form a sliding pair therewith. The drive shaft 170 has a compression coil spring 188 connected to the other end (near the rotation mechanism 164) thereof and is given an initial thrust (or biasing force) by a repulsive force of the spring 188. Hence, the swash plate cam 186 is rotated to reciprocate the drive shaft 170 in the axial direction, thereby allowing the shaft member 159 to go and return in the axial direction. Although the other end of the drive shaft 170 penetrates the gear 168 of the rotation mechanism 164, the gear 168 and the drive shaft 170 are subjected to spline coupling using a key 171, thereby hindering the gear 168 from moving in the axial direction even if the drive shaft 170 moves in the axial direction.

The center core 158 is provided at both ends with sleeves 163 restricting the movement thereof in the axial direction. On the other hand, the shaft member 159 is provided at both ends with collar members 161 each fitted along the inner peripheral surface of the corresponding sleeve 163. When the shaft member 159 is moved in the axial direction, the collar members 161 are guided by the sleeves 163, realizing a smooth movement thereof.

[Control Method]

The stop position (movement distance) of the shaft member 159 in the axial direction varies according to the rotation angle of the swash plate cam 186. The stop position of the shaft member 159 can be controlled, for example, with a drive-pulse number applied to the stepping motor 182. The moving mechanism 180 also has a control circuit (not shown). This control circuit can also be formed, for example, by a control IC, an I/O driver, a semiconductor memory and the like and has control information on stop positions of the shaft member 159 according to sheet sizes stored in advance in the semiconductor memory (e.g., EEPROM). The control IC is notified of information on a present sheet size from an image forming control unit (not shown). Upon receiving the information, the control IC reads from the semiconductor memory information on the stop position of the shaft member 159 suitable for the sheet size and outputs, at a specified cycle, the predetermined number of drive pulses for allowing the shaft member 159 to reach the targeted stop position. The drive pulse is applied to the stepping motor 182 via the output driver to operate the stepping motor 182.

After confirming that the rotation mechanism 180 has finished controlling the stop position of the shaft member 159, the control circuit of the rotation mechanism 164 rotates the stepping motor 166. As described earlier, the block-shaped cores 158*a* outside the sheet conveyed region are rotated according to the sheet size at that time to switch the shielding members 160 from the retracted positions to the shielding positions.

Figure 16B:
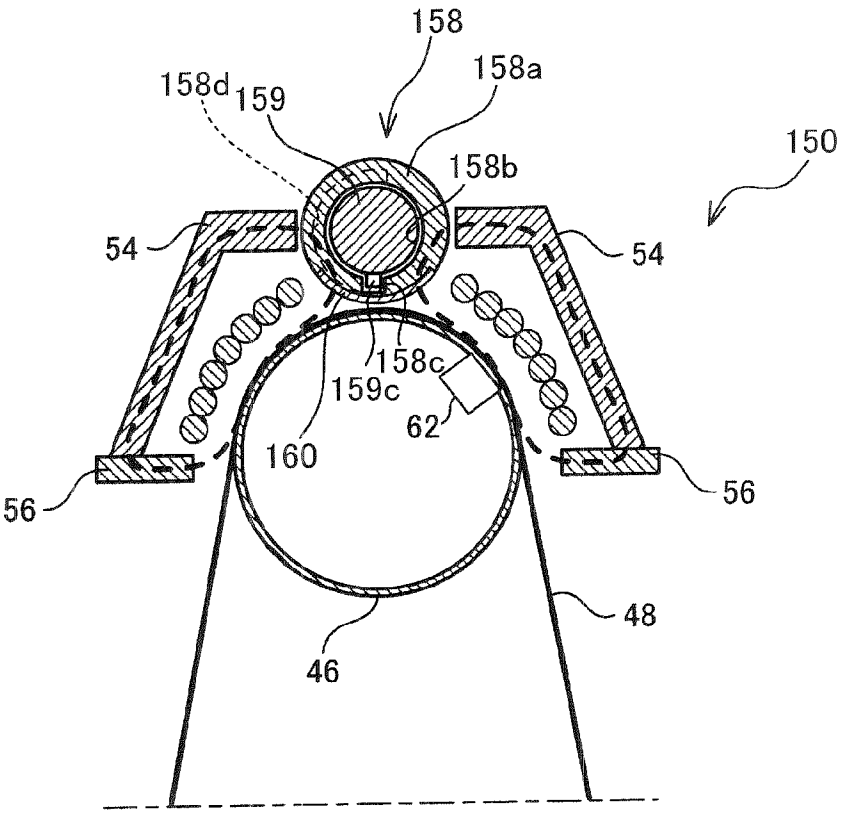
FIGS. 16A and 16B are longitudinal sectional views showing an operation as the shaft member rotates.
Figure 16A:
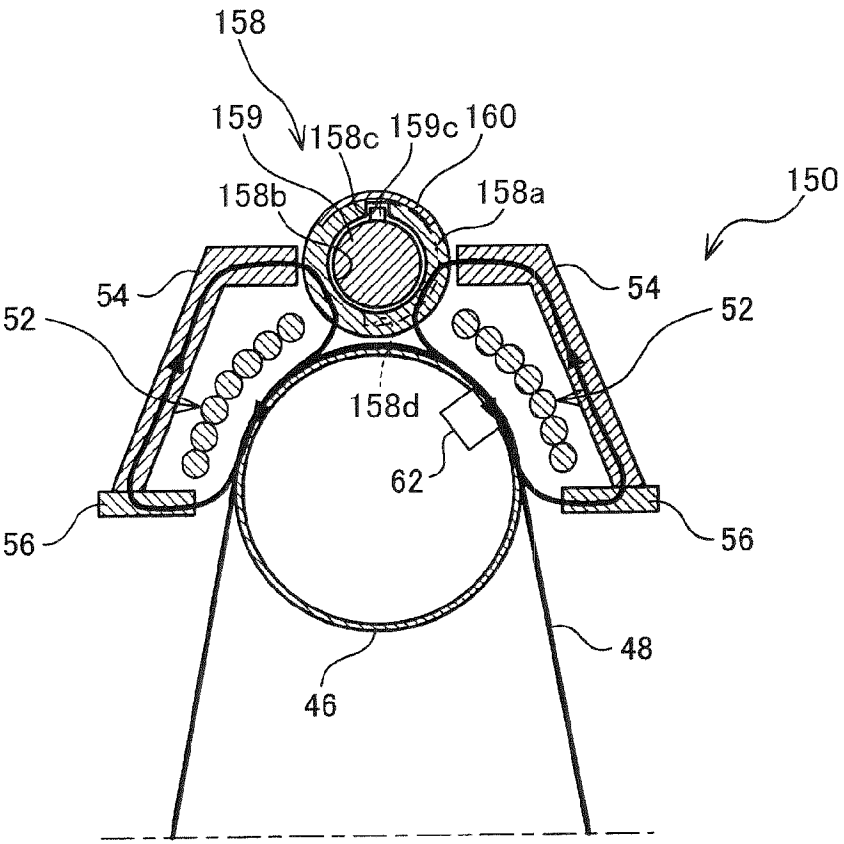

FIGS. 16A and 16B show an operation of the block-shaped core 158*a* as the shaft member 159 rotates. FIG. 16A shows the shielding member 160 held in the retracted position, and in this case, a magnetic field generated by the induction heating coil 52 passes the heating belt 48 and the heat roller 46 through the side cores 56, the arch cores 54 and the center core 158. At this time, the ferromagnetic heating belt 48 and heat roller 46 cause an eddy current and generate Joule heat based on the specific resistance of each material, thereby conducting heating.

FIG. 16B shows the shielding member 160 switched to the shielding position, and in this case, the shielding member 160 is located on a magnetic path outside the sheet conveyed region according to the sheet size, thereby suppressing generation of a magnetic field. This suppresses the quantity of heat generated outside the sheet conveyed region, thereby preventing an excessive temperature rise in the heating belt 48 and the heat roller 46.

Third Embodiment

Figure 17:
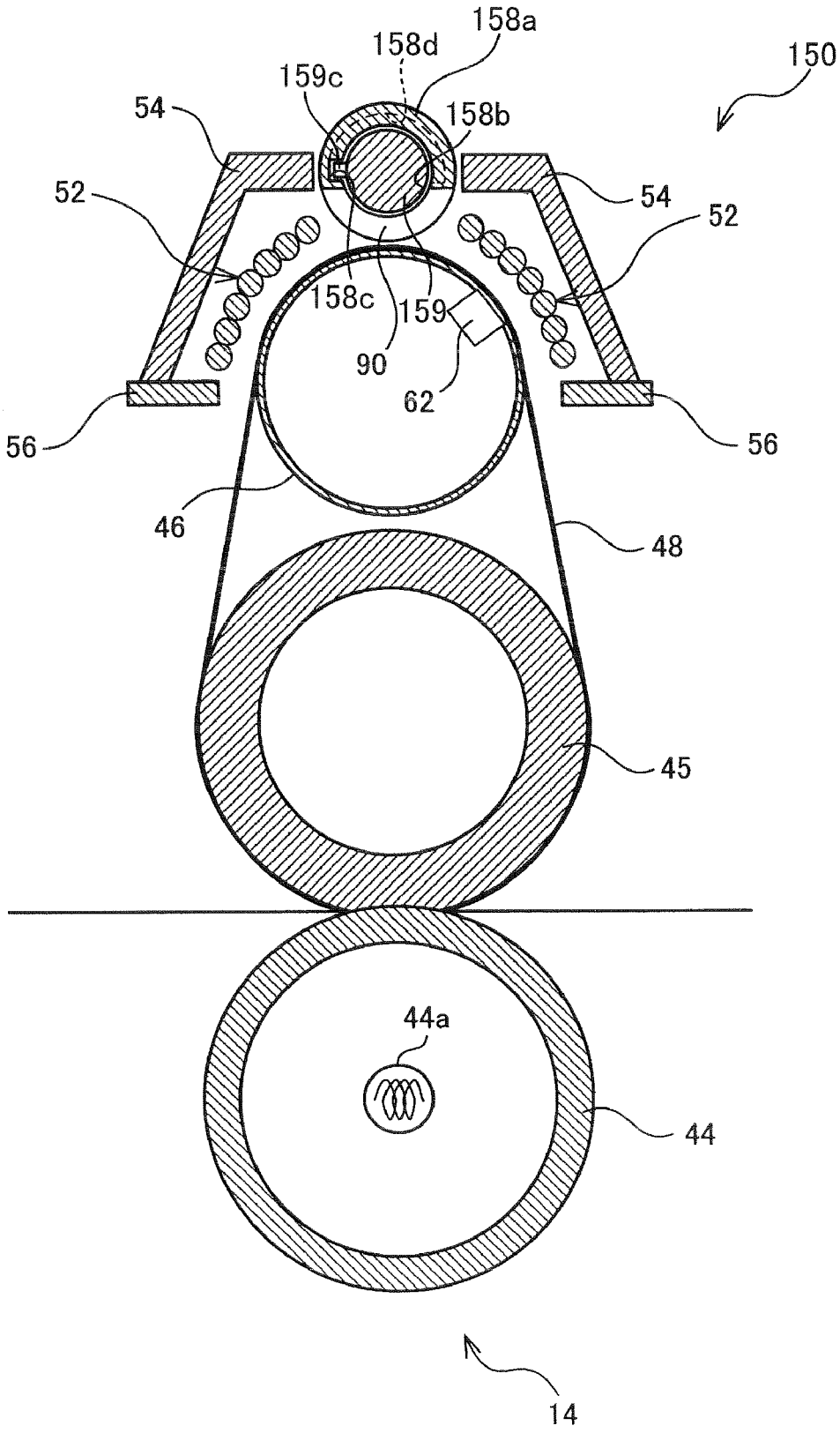
FIG. 17 is a longitudinal sectional view showing a further structural example (second example) of the fixing unit.

FIG. 17 shows the fixing unit 14 according to a third embodiment of the present invention in which the shielding member 160 is replaced with a cut-out portion 90 formed in each of the block-shaped core 158*a*, and hence, each block-shaped core 158*a* has an arcuate shape in section.

[Cut-Out Portion]

The cut-out portion 90 is formed by cutting off a part of the block-shaped core 158*a* along the axial direction of the core 158*a*. The cut-out portion 90 may be formed in a molding die simultaneously when sintering ferrite powder, or formed by cutting a molded column (cylinder). As long as the cut-out portion 90 has an arcuate shape in section in the final form, the manufacturing process is not limited.

In the third embodiment, the block-shaped core 158*a* is formed inside with the axial groove 158*c* and the circumferential groove 158*d*, and the shaft member 159 is formed with the projections 159*a*, 159*b* and 159*c*. The axial groove 158*c* and the circumferential groove 158*d* are located, however, out of the way of the cut-out portion 90. The rotation or non-rotation of the block-shaped core 158 a by the projections 159*a*, 159*b* and 159*c* is the same as that in the second embodiment.

In the third embodiment, control is executed in such a way that the block-shaped cores 158*a* outside the sheet conveyed region in accordance with the size of a sheet are rotated to switch the cut-out portion 90 from the retracted position to a resistance position (shielding position). Specifically, as shown in FIG. 17, the cut-out portion 90 moves to a position (resistance position) adjacent to the surface of the heating belt 48 to increase the magnetic resistance around the induction heating coil 52 and lower the magnetic field strength. Therefore, in the same way as the case where the shielding member 160 is switched to the shielding position in the second embodiment, an excessive temperature rise in the heating belt 48 and the heat roller 46 can be certainly prevented outside the sheet conveyed region.

On the other hand, when the cut-out portion 90 is in the position 180 degrees apart from the position of FIG. 17 or in the position (retracted position) farthest away from the heating belt 48, the magnetic resistance falls around the induction heating coil 52, leading formation of a magnetic path passing through the center core 158, the arch cores 54 and the heat roller 46 on both sides of the center core 158. As a result, the magnetic field works on the heating belt 48 and the heat roller 46. In this case, in the same way as the second embodiment, heat generation necessary for fixing an image can be obtained.

Figure 18:
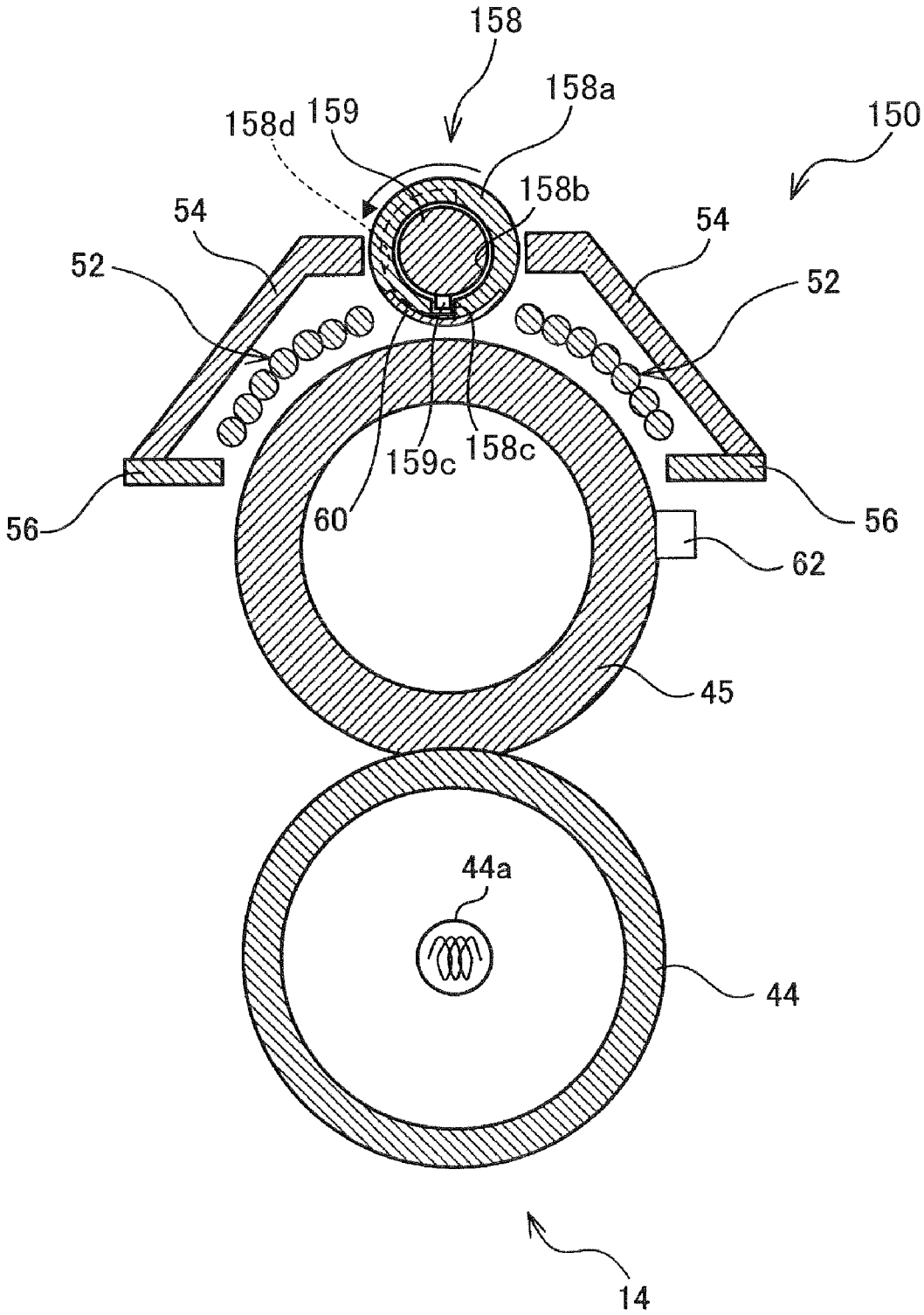
FIG. 18 is a longitudinal sectional view showing a still further structural example (third example) of the fixing unit.

FIG. 18 shows a further structural example of the fixing unit 14 which fixes a toner image between the fixing roller 45 and the pressure roller 44 without using any heating belt. For example, a magnetic body similar to the above heating belt is wound around the outer periphery of the fixing roller 45 and subjected to induction heating by the induction heating coil 52. In this case, the thermistor 62 is arranged outside the fixing roller 45 so as to face the magnetic-body layer. This structural example has the same as the second embodiment and is capable of screening out magnetism outside the sheet conveyed region by rotating the block-shaped core 158*a* together with the shaft member 159.

Figure 19:
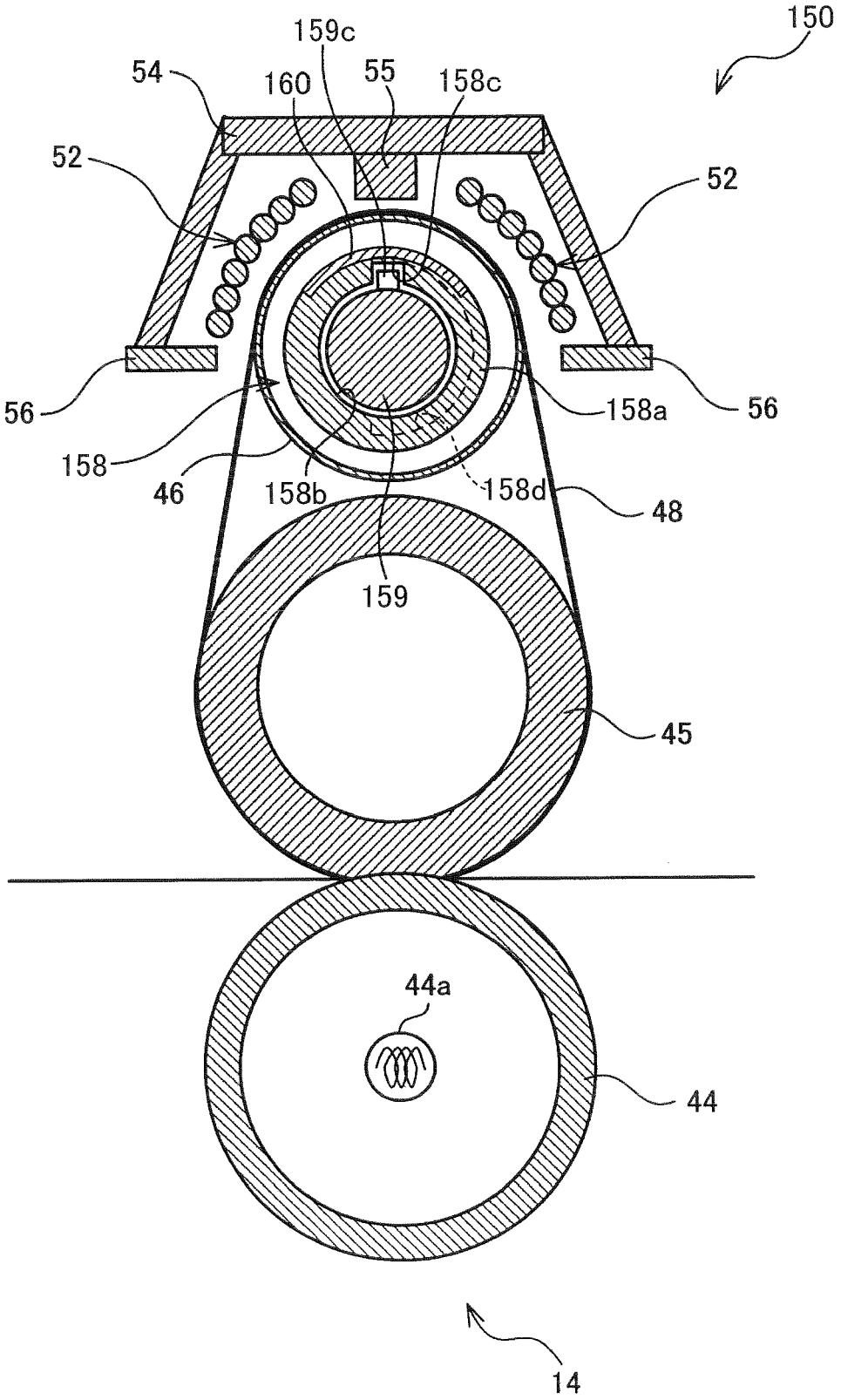
FIG. 19 is a longitudinal sectional view showing a still further structural example (fourth example) of the fixing unit.

FIG. 19 shows a still further structural example of the fixing unit 14 which is different from the second embodiment in that the heat roller 46 is made of a non-magnetic metal (e.g., SUS: stainless steel) and the center core 158 is arranged inside the heat roller 46. Further, the arch core 54 is employed in an integral form and an intermediate core 55 is provided between the arch core 54 and the heating belt 48.

Since the heat roller 46 is a non-magnetic metal, a magnetic field generated by the induction heating coil 52 passes through the side cores 56, the arch core 54 and the intermediate core 55, penetrates the heat roller 46 and reaches the center core 158 inside of the heat roller 46. The penetration magnetic field gives induction heating to the heating belt 48.

In this structural example, as shown in FIG. 19, the shielding member 160 is switched to the position (shielding position) facing the intermediate core 55 to screen out magnetism, thereby suppressing an excessive temperature rise outside the sheet conveyed region. On the other hand, if the shielding member 160 is moved to the opposite side farthest away from the intermediate core 55 and comes to the retracted position, the heating belt 48 undergoes induction heating.

Figure 20:
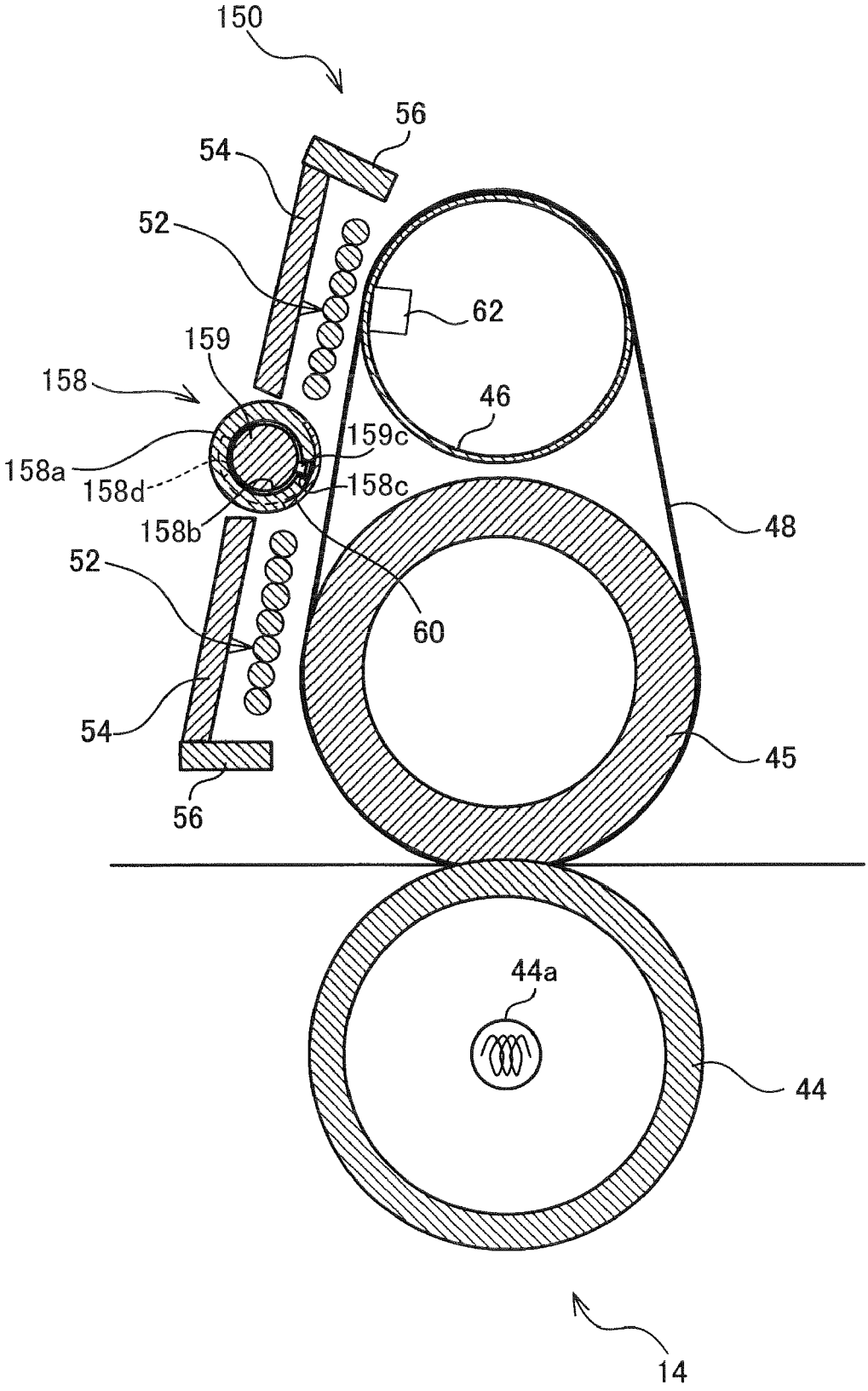
FIG. 20 is a longitudinal sectional view showing a further structural example of an IH coil unit.

Next, FIG. 20 shows a further structural example of the IH coil unit 150 which conducts induction heating, not in the arcuate surface of the heating belt 48, but in a flat surface between the heat roller 46 and the fixing roller 45. In the same way as the second embodiment, this structural example is capable of screening out magnetism outside the sheet conveyed region by rotating the block-shaped cores 158*a* together with the shaft member 159.

Figure 21:
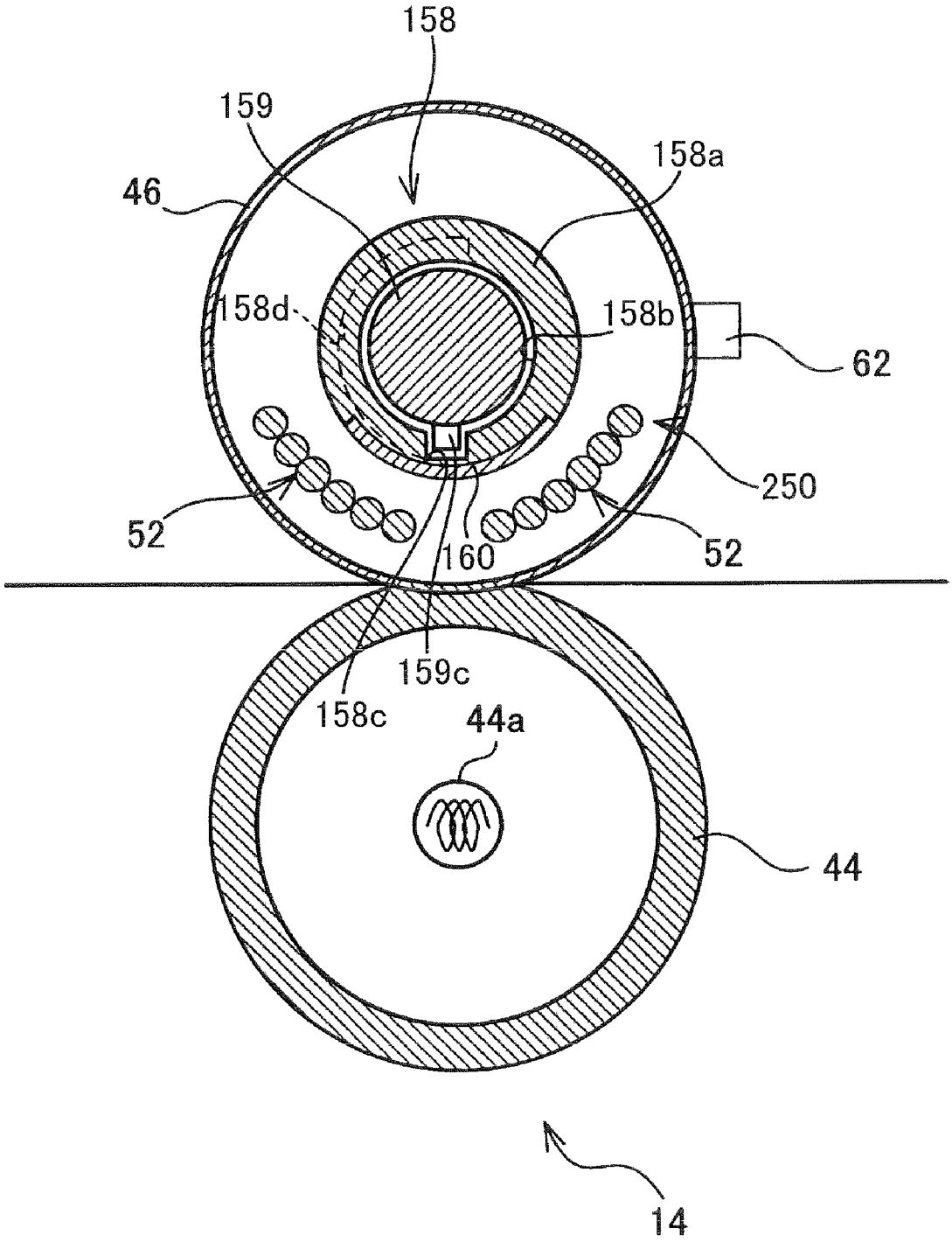
FIG. 21 is a longitudinal sectional view showing a structural example of an internal type IH coil unit.

FIG. 21 shows a structural example of an internal type IH coil unit. In all the above examples, the induction heating coil 52 is arranged so as to surround the heat roller 46 while in an internal type IH coil unit 250, the whole induction heating coil 52 is arranged inside of the heat roller 46.

The internal type IH coil unit 250 includes only the center core 158 without such an arch core nor a side core as described above. A magnetic field generated by the induction heating coil 52 passes the peripheral surface of the heat roller 46 and enters the center core 158, then passes through the middle of the induction heating coil 52 from the center core 158, and reaches a vicinity of the nip between the heat roller 46 and the pressure roller 44. Although the center core 158 is inside of the heat roller 46, in the same way as the second embodiment, the block-shaped cores 158*a* are rotated together with the shaft member 159, thereby screening out magnetism outside the sheet conveyed region.

Diverse variations are feasible in the second embodiment and the third embodiments. For example, the number of the block-shaped cores 158*a* obtained by division is not limited especially to the embodiments, and hence, may be varied suitably for the size of a sheet in use.

In the first to third embodiments, the plate-shaped shielding member 160 is employed to adjust (screen out) magnetism. However, the shielding member 160 may be made of a non-magnetic metal (e.g., oxygen-free copper) and have a closed-ring shape. In this case, in the shielding member 160, a magnetic flux penetrating the closed ring generates a magnetic field working in a direction opposite to the direction in which the magnetic field generated by the induction heating coil 52 works. As a result, the opposite magnetic filed generated in the shielding member 160 cancels the magnetic field generated by the coil 52. Accordingly, the same magnetism-shielding effect as the first to third embodiments can be obtained.

Further, the specific forms of each component element including the arch core 54 or the side cores 56 are not limited to the ones shown in the figures, and thus, can be suitably varied.

The image forming apparatus and particularly, the fixing unit described so far mainly have the following configuration.

The image forming apparatus includes An image forming apparatus includes an image forming section forming a toner image and transferring the toner image onto a sheet and a fixing unit including a heating member and a pressure member. The fixing unit is operable to fix the toner image onto the sheet while nipping and conveying the sheet between the heating member and the pressure member. The heating member has a sheet conveyed region that the sheet passes. The sheet conveyed region is set in accordance with the size of the sheet being conveyed. The fixing unit further includes a coil arranged along an outer surface of the heating member and generating a magnetic field, a fixed core arranged opposite to the heating member with respect to the coil and forming a magnetic path, a plurality of movable cores arranged between the fixed core and the heating member with respect to a direction in which the coil generates a magnetic field, to form the magnetic path together with the fixed core, and also arranged along the sheet conveyed region, a shielding member arranged along an outer surface of at least one movable core and shielding magnetism, and a magnetism adjustment unit rotating at least one movable core around a predetermined axis to switch the position of the shielding member between a shielding position where the shielding member is positioned inside the sheet conveyed region to shield the magnetism and a retracted position where the shielding member is positioned outside the sheet conveyed region to permit pass of the magnetism.

The image forming apparatus having the above configuration employs the method (external IH) of giving induction heating to the heating member by a magnetic field generated by the coil to heat and melt a toner image. Therefore, there is no need to provide any particular member inside the heating member. Besides, in order to form a magnetic path for leading a magnetic field generated by the coil, the fixed core is arranged around the coil, and the plurality of movable cores are simply arranged between the fixed core and the heating member, thereby avoiding making the space occupied by the whole thereof larger.

Furthermore, the image forming apparatus having the above configuration is capable of adjusting the generated-heat quantity of the heating member only by rotating at least one movable core. Specifically, if the magnetism adjustment unit rotates the movable core to move the shielding member to the retracted position, a magnetic field generated by the coil is led to the fixed core and the movable core, causing the heating member to generate an eddy current and conducting magnetic induction heating. On the other hand, if the magnetism adjustment unit rotates the movable core to move the shielding member to the shielding position, the magnetic resistance in the magnetic path increases to lower the magnetic field strength, thereby reducing the generated-heat quantity of the heating member.

Moreover, in the image forming apparatus having the above configuration, there is no need to move the core away from the heating member in adjusting the generated-heat quantity of the heating member, thereby saving a space.

Besides, there is no need to provide inside the heating member a core for magnetic induction or an electrically-conductive member for magnetic field adjustment, thereby suppressing an increase in the heat capacity and shortening the warm-up time.

In addition, in the image forming apparatus having the above configuration, it is preferable that the shielding member is provided on the outer surface of each movable core and the magnetism adjustment unit rotates the plurality of movable cores individually.

According to this configuration, the plurality of movable cores are individually rotated to switch the position of the shielding member of each movable core independently, thereby adjusting the generated-heat quantity of the heating member in accordance with a variety of sheet sizes (sheet conveyed regions). For example, when the sheet size is minimum, control is executed in such a way that the shielding member of the movable core outside the minimum sheet conveyed region with respect to the sheet width direction is switched to the shielding position, thereby preventing an excessive temperature rise in the heating member outside the minimum sheet conveyed region. Besides, if the sheet size is changed, control is executed in such a way that the shielding member of the movable core outside the sheet conveyed region in accordance with the sheet size is switched to the shielding position, thereby quickly responding to a switch of the sheet size while certainly preventing an excessive temperature rise in the heating member outside the sheet conveyed region.

Furthermore, in the image forming apparatus having the above configuration, preferably, the magnetism adjustment unit includes a common rotation unit simultaneously rotating the outer movable cores arranged at positions corresponding to ends of a maximum sheet conveyed region set when a sheet having a maximum size is conveyed, and a plurality of individual rotation units individually rotating a corresponding one of the other inner movable cores positioned between the outer movable cores.

According to this configuration, the common rotation unit rotates outer movable cores together to switch the respective shielding members simultaneously to the shielding positions, thereby screening out magnetism easily on the outermost side of the sheet conveyed region and quickly responding to a switch of the sheet size.

Moreover, in the image forming apparatus having the above configuration, it is preferable that the outer movable core and the inner movable core are each a cylindrical core having a through hole formed along the axis thereof. It is also preferable that the common rotation unit includes a rotating shaft member fitted in the through holes of the outer movable cores and fitted loosely in the through holes of the inner movable cores, and a drive source rotating the rotating shaft member whereas each of the individual rotation units includes a rotating roller pressed into contact with an peripheral surface of the corresponding inner movable core and undergoing rotation to transmit a friction force to the peripheral surface, and a drive source rotating the rotating roller.

In addition, in the image forming apparatus having the above configuration, it is preferable that the movable cores include a first movable core arranged inside a minimum sheet conveyed region set when a sheet having a minimum size is conveyed and a second movable core arranged outside the minimum sheet conveyed region and also that the shielding member is provided in not the first movable core but the second movable core.

According to this configuration, since the shielding member is not provided in the movable core arranged inside the minimum sheet conveyed region, screening out magnetism by the shielding member is not carried out, thereby constantly transmitting a magnetic flux to the heating member.

Furthermore, in the image forming apparatus having the above configuration, it is preferable that among the plurality of movable cores, the magnetism adjustment unit rotates a movable core arranged outside the sheet conveyed region set in accordance with the size of the sheet to switch the position of the shielding member of the movable core from the retracted position to the shielding position.

According to this configuration, the shielding member of the movable core inside the sheet conveyed region (within the heated range) is switched to the retracted position, a magnetic field generated by the coil passes the fixed core and the movable core, thereby causing the heating member to generate an eddy current and conducting magnetic induction heating. On the other hand, when the magnetism adjustment unit rotates the movable core outside the minimum sheet conveyed region to move the shielding member to the shielding position, the magnetic resistance inside the magnetic path increases to lower the magnetic-field strength, thereby reducing the generated-heat quantity of the heating member. This makes it possible to certainly prevent an excessive temperature rise in the heating member outside the sheet conveyed region.

Moreover, in the image forming apparatus having the above configuration, it is preferable that the plurality of movable cores are formed by dividing a single core into a plurality of cores and the single core has a through hole of a circular sectional shape formed along the axis thereof. It is also preferable that the magnetism adjustment unit includes a shaft member fitted loosely in the through holes of the movable cores and supporting the movable cores rotatably, a guide groove formed in an inner peripheral surface of each movable core, an engagement portion provided in the shaft member and engageable with the guide groove, and a drive mechanism driving the shaft member. The shape of the guide groove is preferably set in such a way that as the shaft member is driven, the engagement portion moves in the guide groove to rotate the movable cores.

The magnetism adjustment unit preferably has the following specific configuration. The engagement portion is a plurality of projections provided on an outer peripheral surface of the shaft member and spaced at a predetermined interval from each other in the axial direction of the shaft member. The drive mechanism includes a moving mechanism moving the shaft member in the through holes in the axial direction of the movable cores and a rotation mechanism rotating the shaft member in the through holes around the axis of the shaft member. The guide groove includes an axial groove formed at the inner peripheral surfaces of the movable cores over the movable cores in the axial direction of the movable cores, and a circumferential groove formed at the inner peripheral surface to extend from the axial groove in the circumferential direction of the movable core. The axial groove has a shape capable of receiving the projections. The projections move in the axial groove relative to the movable cores in the axial direction of the movable cores when the moving mechanism moves the shaft member. The circumferential groove has a shape capable of receiving the projections. The projections move in the circumferential groove relative to the movable cores in the circumferential direction of the movable core when the rotation mechanism rotates the shaft member. When the moving mechanism moves the shaft member in the axial direction, the projections are switched to a position where the projections are received in the circumferential groove or a position where the projections are not received in the circumferential groove. When the projections are switched to the position where the projections are received, the rotation of the shaft member by the rotation mechanism keeps the shielding member in the retracted position, while when the projections are switched to the position where the projections are not received, the rotation of the shaft member by the rotation mechanism switches the position of the shielding member from the retracted position to the shielding position.

The magnetism adjustment unit having the above configuration is capable of selectively rotating the movable cores individually only using the moving mechanism and the rotation mechanism, thereby making it unnecessary to employ a rotation mechanism having a motor for each movable core to simplify the structure.

In addition, in the image forming apparatus having the above configuration, it is preferable that the movable core is a cylindrical core and, instead of the shielding member, includes a cut-out portion so formed by cutting off a peripheral part thereof as to have an arcuate shape in section viewed from the axial direction. When the projections are switched to the position where the projections are received in the circumferential groove, the rotation of the shaft member by the rotation mechanism keeps the cut-out portion in the retracted position, while when the projections are switched to the position where the projections are not received in the circumferential groove, the rotation of the shaft member by the rotation mechanism switches the cut-out portion from the retracted position to the shielding position.

According to the above configuration, when the magnetism adjustment unit rotates the movable core to switch the cut-out portion to the retracted position, a magnetic field generated by the coil passes the fixed core and the movable core, thereby causing the heating member to generate an eddy current and conducting magnetic induction heating. On the other hand, when the magnetism adjustment unit rotates the movable core to switch the cut-out portion to a resistance position (shielding position), the magnetic resistance inside the magnetic path increases (an air gap is substituted for a part of the magnetic path) to lower the magnetic-field strength, thereby reducing the generated-heat quantity of the heating member. Likewise in this case, the movable cores are arranged in the width direction of a sheet, thereby preventing an excessive temperature rise in accordance with a variety of sheet sizes. Besides, the individual movable cores are rotated to switch the cut-out portion to the resistance position, thereby certainly suppressing the quantity of magnetism passing outside the sheet conveyed region.

This application is based on Japanese patent application serial Nos. 2008-085377 and 2008-170520, filed in Japan Patent Office on Mar. 28, 2008 and Jun. 30, 2008 respectively, the contents of which are hereby incorporated by reference.

Although the present invention has been fully described by way of example with reference to the accompanied drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus comprising:

an image forming section forming a toner image and transferring the toner image onto a sheet; and a fixing unit including a heating member and a pressure member, the fixing unit operable to fix the toner image onto the sheet while nipping and conveying the sheet between the heating member and the pressure member, wherein:

the heating member has a sheet conveyed region that the sheet passes, the sheet conveyed region being set in accordance with the size of the sheet being conveyed, and the fixing unit further includes:

a coil arranged along an outer surface of the heating member and generating a magnetic field, a fixed core arranged opposite to the heating member with respect to the coil and forming a magnetic path, a plurality of movable cores arranged between the fixed core and the heating member with respect to a direction in which the coil generates a magnetic field, to form the magnetic path together with the fixed core, and also arranged along the sheet conveyed region, a shielding member arranged along an outer surface of at least one movable core and shielding magnetism, and a magnetism adjustment unit rotating at least one movable core around a predetermined axis to switch the position of the shielding member between a shielding position where the shielding member is positioned inside the sheet conveyed region to shield the magnetism and a retracted position where the shielding member is positioned outside the sheet conveyed region to permit pass of the magnetism.

2. The image forming apparatus according to claim 1, wherein:

the shielding member is provided on the outer surface of each movable core; and the magnetism adjustment unit rotates the plurality of movable cores individually.

3. The image forming apparatus according to claim 2, wherein the magnetism adjustment unit includes:

a common rotation unit simultaneously rotating the outer movable cores arranged at positions corresponding to ends of a maximum sheet conveyed region set when a sheet having a maximum size is conveyed; and a plurality of individual rotation units individually rotating a corresponding one of the other inner movable cores positioned between the outer movable cores.

4. The image forming apparatus according to claim 3, wherein:

the outer movable core and the inner movable core are each a cylindrical core having a through hole formed along the axis thereof;

the common rotation unit includes a rotating shaft member fitted in the through holes of the outer movable cores and fitted loosely in the through holes of the inner movable cores, and a drive source rotating the rotating shaft member; and each of the individual rotation units includes a rotating roller pressed into contact with an peripheral surface of the corresponding inner movable core and undergoing rotation to transmit a friction force to the peripheral surface, and a drive source rotating the rotating roller.

5. The image forming apparatus according to claim 2, wherein:

the movable cores include a first movable core arranged inside a minimum sheet conveyed region set when a sheet having a minimum size is conveyed, and a second movable core arranged outside the minimum sheet conveyed region; and the shielding member is provided in not the first movable core but the second movable core.

6. The image forming apparatus according to claim 1, wherein among the plurality of movable cores, the magnetism adjustment unit rotates a movable core arranged outside the sheet conveyed region set in accordance with the size of the sheet to switch the position of the shielding member of the movable core from the retracted position to the shielding position.

7. The image forming apparatus according to claim 6, wherein:

the plurality of movable cores are formed by dividing a single core into a plurality of cores, the single core having a through hole of a circular sectional shape formed along the axis thereof;

the magnetism adjustment unit includes a shaft member fitted loosely in the through holes of the movable cores and supporting the movable cores rotatably, a guide groove formed in an inner peripheral surface of each movable core, an engagement portion provided in the shaft member and engageable with the guide groove, and a drive mechanism driving the shaft member; and the shape of the guide groove is set in such a way that as the shaft member is driven, the engagement portion moves in the guide groove to rotate the movable cores.

8. The image forming apparatus according to claim 7, wherein:

the engagement portion is a plurality of projections provided on an outer peripheral surface of the shaft member and spaced at a predetermined interval from each other in the axial direction of the shaft member;

the drive mechanism includes a moving mechanism moving the shaft member in the through holes in the axial direction of the movable cores and a rotation mechanism rotating the shaft member in the through holes around the axis of the shaft member;

the guide groove includes an axial groove formed at the inner peripheral surfaces of the movable cores over the movable cores in the axial direction of the movable cores, and a circumferential groove formed at the inner peripheral surface to extend from the axial groove in the circumferential direction of the movable core;

the axial groove has a shape capable of receiving the projections, the projections moving in the axial groove relative to the movable cores in the axial direction of the movable cores when the moving mechanism moves the shaft member;

the circumferential groove has a shape capable of receiving the projections, the projections moving in the circumferential groove relative to the movable cores in the circumferential direction of the movable core when the rotation mechanism rotates the shaft member;

when the moving mechanism moves the shaft member in the axial direction, the projections are switched to a position where the projections are received in the circumferential groove or a position where the projections are not received in the circumferential groove; and when the projections are switched to the position where the projections are received, the rotation of the shaft member by the rotation mechanism keeps the shielding member in the retracted position, while when the projections are switched to the position where the projections are not received, the rotation of the shaft member by the rotation mechanism switches the position of the shielding member from the retracted position to the shielding position.

9. The image forming apparatus according to claim 8, wherein:

the movable core is a cylindrical core and, instead of the shielding member, includes a cut-out portion so formed by cutting off a peripheral part thereof as to have an arcuate shape in section viewed from the axial direction; and when the projections are switched to the position where the projections are received in the circumferential groove, the rotation of the shaft member by the rotation mechanism keeps the cut-out portion in the retracted position, while when the projections are switched to the position where the projections are not received in the circumferential groove, the rotation of the shaft member by the rotation mechanism switches the cut-out portion from the retracted position to the shielding position.

* * * * *